US007993195B2

(12) United States Patent
Belger et al.

(10) Patent No.: US 7,993,195 B2
(45) Date of Patent: Aug. 9, 2011

(54) GAMING DEVICE HAVING SEQUENTIAL ACTIVATIONS OF A GAME AND REPLAY OF PREVIOUS ACTIVATIONS OF THE GAME

(75) Inventors: Matthew E. Belger, N. Las Vegas, NV (US); Darren Maya, Reno, NV (US); Anisur R Chowdhury, Reno, NV (US); Hans Elias, Reno, NV (US); Karen M Cregan, Reno, NV (US); Anthony J Baerlocher, Reno, NV (US)

(73) Assignee: IGT, Reno, NV (US)

( * ) Notice: Subject to any disclaimer, the term of this patent is extended or adjusted under 35 U.S.C. 154(b) by 876 days.

(21) Appl. No.: 12/014,533

(22) Filed: Jan. 15, 2008

(65) Prior Publication Data

US 2008/0113761 A1 May 15, 2008

Related U.S. Application Data

(63) Continuation of application No. 10/956,508, filed on Oct. 1, 2004, now Pat. No. 7,322,887.

(51) Int. Cl.
*A63F 9/24* (2006.01)

(52) U.S. Cl. ..... 463/20

(58) Field of Classification Search ..... None
See application file for complete search history.

(56) References Cited

U.S. PATENT DOCUMENTS 4,198,052 A 4/1980 Gauselmann
4,421,310 A 12/1983 Williams
4,624,459 A 11/1986 Kaufman
4,669,731 A 6/1987 Clarke
4,695,053 A 9/1987 Vazquez, Jr. et al.
4,826,169 A 5/1989 Bessho et al.
5,178,390 A 1/1993 Okada
5,205,555 A 4/1993 Hamano (Continued)

FOREIGN PATENT DOCUMENTS

EP 0 874 337 A1 10/1998

(Continued)

OTHER PUBLICATIONS

Addams Family Advertisement, written by IGT, published in 2000.

(Continued)

*Primary Examiner* — Corbett B Coburn
(74) *Attorney, Agent, or Firm* — K&L Gates LLP

(57) ABSTRACT

A gaming device including a plurality of reels with a plurality of symbols on each of the reels. At least one and preferably a plurality of the symbols on the primary reels are designated as tracking or back symbols. A tracking symbol is a symbol that, when generated on a reel, causes the gaming device to flag the outcome of the current and all tracking spins in a memory storage device. A back symbol is a symbol that, when generated on a reel, causes the gaming device to retrieve the flagged outcomes of each flagged spin and to re-display the outcomes in a sequential manner and to provide the awards associated with the outcomes to the player. An additional embodiment of the invention automatically flags all spins of the gaming device for retrieval and display upon the generation of a back or bonus symbol. The gaming device determines if an award is associated with one or more of the symbols generated on the reels and provides any determined award to the player.

26 Claims, 15 Drawing Sheets

U.S. PATENT DOCUMENTS

| | | | |
|---|---|---|---|
| 5,342,047 | A | 8/1994 | Heidel et al. |
| 5,393,057 | A | 2/1995 | Marnell, II |
| 5,407,200 | A | 4/1995 | Zalabak |
| 5,423,539 | A | 6/1995 | Nagao |
| 5,449,173 | A | 9/1995 | Thomas et al. |
| 5,456,465 | A | 10/1995 | Durham |
| 5,472,196 | A | 12/1995 | Rusnak |
| 5,560,603 | A | 10/1996 | Seelig et al. |
| 5,647,798 | A | 7/1997 | Falciglia |
| 5,695,404 | A | 12/1997 | Stupak |
| 5,711,525 | A | 1/1998 | Breeding |
| 5,722,891 | A | 3/1998 | Inoue |
| 5,772,506 | A | 6/1998 | Marks et al. |
| 5,775,692 | A | 7/1998 | Watts et al. |
| 5,779,544 | A | 7/1998 | Seelig et al. |
| 5,788,573 | A | 8/1998 | Baerlocher et al. |
| 5,807,172 | A | 9/1998 | Piechowiak |
| 5,823,874 | A | 10/1998 | Adams |
| 5,848,932 | A | 12/1998 | Adams |
| 5,851,010 | A | 12/1998 | Feinberg |
| 5,851,148 | A | 12/1998 | Brune et al. |
| 5,855,514 | A | 1/1999 | Kamille |
| 5,882,261 | A | 3/1999 | Adams |
| 5,911,418 | A | 6/1999 | Adams |
| 5,918,880 | A | 7/1999 | Voigt, IV et al. |
| 5,919,088 | A | 7/1999 | Weiss |
| 5,935,002 | A | 8/1999 | Falciglia |
| 5,947,820 | A | 9/1999 | Morro et al. |
| 5,954,335 | A | 9/1999 | Moody |
| 5,964,463 | A | 10/1999 | Moore, Jr. |
| 5,971,849 | A | 10/1999 | Falciglia |
| 5,980,384 | A | 11/1999 | Barrie |
| 5,984,782 | A | 11/1999 | Inoue |
| 5,988,638 | A | 11/1999 | Rodesch et al. |
| 5,997,400 | A | 12/1999 | Seelig et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,012,982 | A | 1/2000 | Piechowialt et al. |
| 6,015,344 | A | 1/2000 | Kelly et al. |
| 6,015,346 | A | 1/2000 | Bennett |
| 6,045,129 | A | 4/2000 | Cooper |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,089,976 | A | 7/2000 | Schneider et al. |
| 6,089,977 | A | 7/2000 | Bennett |
| 6,089,978 | A | 7/2000 | Adams |
| 6,102,400 | A | 8/2000 | Scott et al. |
| 6,102,798 | A | 8/2000 | Bennett |
| 6,113,098 | A | 9/2000 | Adams |
| 6,120,378 | A | 9/2000 | Moody et al. |
| 6,126,542 | A | 10/2000 | Fier |
| 6,142,873 | A | 11/2000 | Weiss et al. |
| 6,142,874 | A | 11/2000 | Kodachi et al. |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,203,429 | B1 | 3/2001 | Demar et al. |
| 6,217,447 | B1 | 4/2001 | Lofink et al. |
| 6,220,959 | B1 | 4/2001 | Holmes, Jr. et al. |
| 6,224,482 | B1 | 5/2001 | Bennett |
| 6,224,483 | B1 | 5/2001 | Mayeroff |
| 6,227,971 | B1 | 5/2001 | Weiss |
| 6,231,442 | B1 | 5/2001 | Mayeroff |
| 6,231,445 | B1 | 5/2001 | Acres |
| 6,234,879 | B1 | 5/2001 | Hasegawa et al. |
| 6,234,897 | B1 | 5/2001 | Frohm et al. |
| 6,238,287 | B1 | 5/2001 | Komori et al. |
| 6,251,013 | B1 | 6/2001 | Bennett |
| 6,261,128 | B1 | 7/2001 | Heim et al. |
| 6,261,177 | B1 | 7/2001 | Bennett |
| 6,270,409 | B1 | 8/2001 | Shuster |
| 6,270,411 | B1 | 8/2001 | Gura et al. |
| 6,270,412 | B1 | 8/2001 | Crawford et al. |
| 6,299,165 | B1 | 10/2001 | Nagano |
| 6,302,790 | B1 | 10/2001 | Brossard |
| 6,305,686 | B1 | 10/2001 | Perrie et al. |
| 6,309,300 | B1 | 10/2001 | Glavich |
| 6,311,976 | B1 | 11/2001 | Yoseloff et al. |
| 6,312,334 | B1 | 11/2001 | Yoseloff |
| 6,315,660 | B1 | 11/2001 | DeMar et al. |
| 6,315,663 | B1 | 11/2001 | Sakamoto |
| 6,328,649 | B1 | 12/2001 | Randall et al. |
| 6,334,864 | B1 | 1/2002 | Amplatz et al. |
| 6,340,158 | B2 | 1/2002 | Pierce et al. |
| 6,346,043 | B1 | 2/2002 | Colin et al. |
| 6,347,996 | B1 | 2/2002 | Gilmore et al. |
| RE37,588 | E | 3/2002 | Ornstein |
| 6,358,147 | B1 | 3/2002 | Jaffe et al. |
| 6,364,766 | B1 | 4/2002 | Anderson et al. |
| 6,364,768 | B1 | 4/2002 | Acres et al. |
| 6,368,216 | B1 | 4/2002 | Hedrick et al. |
| 6,375,567 | B1 | 4/2002 | Acres |
| 6,394,902 | B1 | 5/2002 | Glavich et al. |
| 6,398,218 | B1 | 6/2002 | Vancura |
| 6,398,644 | B1 | 6/2002 | Perrie et al. |
| 6,443,452 | B1 | 9/2002 | Brune |
| 6,464,582 | B1 | 10/2002 | Baerlocher et al. |
| 6,471,208 | B2 | 10/2002 | Yoseloff et al. |
| 6,481,713 | B2 | 11/2002 | Perrie et al. |
| 6,491,584 | B2 | 12/2002 | Graham et al. |
| 6,537,150 | B1 | 3/2003 | Luciano et al. |
| 6,537,152 | B2 | 3/2003 | Seelig et al. |
| 6,547,242 | B1 | 4/2003 | Sugiyama et al. |
| 6,561,904 | B2 | 5/2003 | Loche et al. |
| 6,565,436 | B1 | 5/2003 | Baerlocher |
| 6,602,137 | B2 | 8/2003 | Kaminkow et al. |
| 6,604,740 | B1 | 8/2003 | Singer et al. |
| 6,638,164 | B2 | 10/2003 | Randall et al. |
| 6,676,512 | B2 | 1/2004 | Fong et al. |
| 6,712,694 | B1 | 3/2004 | Nordman |
| 6,733,389 | B2 | 5/2004 | Webb et al. |
| 6,805,349 | B2 | 10/2004 | Baerlocher et al. |
| 6,869,360 | B2 | 3/2005 | Marks et al. |
| 6,905,406 | B2 | 6/2005 | Kaminkow et al. |
| 6,913,532 | B2 | 7/2005 | Baerlocher et al. |
| 6,921,335 | B2 | 7/2005 | Rodgers et al. |
| 6,955,600 | B2 | 10/2005 | Glavich et al. |
| 7,066,815 | B2 | 6/2006 | Walker et al. |
| 2001/0009865 | A1 | 7/2001 | Demar et al. |
| 2002/0010017 | A1 | 1/2002 | Bennett |
| 2003/0036424 | A1 | 2/2003 | Baerlocher |
| 2003/0060272 | A1 | 3/2003 | Glavich et al. |
| 2003/0064786 | A1 | 4/2003 | Weiss |
| 2003/0073483 | A1 | 4/2003 | Glavich et al. |
| 2003/0104856 | A1* | 6/2003 | Wolf ..... 463/16 |
| 2003/0162585 | A1 | 8/2003 | Bigelow et al. |
| 2003/0203753 | A1 | 10/2003 | Muir et al. |
| 2004/0002372 | A1 | 1/2004 | Rodgers et al. |
| 2004/0038731 | A1 | 2/2004 | Englman |
| 2004/0048651 | A1 | 3/2004 | Vorias et al. |
| 2004/0053657 | A1 | 3/2004 | Fiden et al. |
| 2004/0053662 | A1 | 3/2004 | Pacey |
| 2004/0053666 | A1 | 3/2004 | Vancura |
| 2004/0053669 | A1 | 3/2004 | Gerrard et al. |
| 2004/0053672 | A1 | 3/2004 | Baerlocher |
| 2004/0072612 | A1 | 4/2004 | Rodgers et al. |
| 2004/0137982 | A1 | 7/2004 | Cuddy et al. |
| 2004/0147306 | A1 | 7/2004 | Randall et al. |
| 2004/0266516 | A1 | 12/2004 | Thomas |
| 2004/0266517 | A1 | 12/2004 | Bleich et al. |
| 2005/0014556 | A1 | 1/2005 | Duhamel |
| 2005/0014562 | A1 | 1/2005 | Fujimoto |
| 2005/0049035 | A1 | 3/2005 | Baerlocher et al. |
| 2005/0064926 | A1 | 3/2005 | Walker et al. |

| | | | |
|---|---|---|---|
| 2005/0070354 | A1 | 3/2005 | Baerlocher et al. |
| 2005/0075163 | A1 | 4/2005 | Cuddy et al. |
| 2005/0233801 | A1 | 10/2005 | Baerlocher et al. |
| 2005/0266917 | A1 | 12/2005 | Glavich et al. |
| 2006/0003834 | A1 | 1/2006 | Okada |

FOREIGN PATENT DOCUMENTS

| | | | |
|---|---|---|---|
| EP | 0945837 | A2 | 3/1999 |
| EP | 0 981 119 | A2 | 2/2000 |
| EP | 1 184 822 | A3 | 3/2000 |
| EP | 0984409 | A2 | 3/2000 |
| EP | 1 513 117 | A2 | 3/2005 |
| GB | 2 090 690 | A | 7/1982 |
| GB | 2 096 376 | A | 10/1982 |
| GB | 2 097 160 | A | 10/1982 |
| GB | 2 100 905 | A | 1/1983 |
| GB | 2 105 891 | A | 3/1983 |
| GB | 2 117 155 | A | 10/1983 |
| GB | 2 137 392 | A | 10/1984 |
| GB | 2 144 644 | A | 3/1985 |
| GB | 2 161 008 | A | 1/1986 |
| GB | 2 170 643 | A | 8/1986 |
| GB | 2 181 589 | A | 4/1987 |
| GB | 2 183 882 | A | 6/1987 |
| GB | 2 191 030 | A | 12/1987 |
| GB | 2 222 712 | A | 3/1990 |
| GB | 2 225 889 | A | 6/1990 |
| GB | 2 226 436 | A | 6/1990 |
| GB | 2 242 300 | A | 9/1991 |
| GB | 2 262 642 | A | 6/1993 |
| GB | 2 322 217 | A | 8/1998 |
| WO | WO 00/12186 | | 3/2000 |
| WO | WO 00/32286 | | 6/2000 |
| WO | WO 01/26019 | A1 | 4/2001 |
| WO | WO 2004/025584 | A2 | 3/2004 |

OTHER PUBLICATIONS

Barn Yard Advertisement, written by Aristocrat, published prior to 2004.
Barn Yard Article, written by Strictly Slots, published in Mar. 2002.
Caribbean Gold II Advertisement, written by Aristocrat, published in 1998.
Catch a Wave Advertisement, written by IGT, published in 2001.
Dolphin Treasure Advertisement, written by Aristocrat Leisure Industries Pty., Ltd., published in 1996.
Double Diamond Run Advertisement, written by IGT, published prior to 2004.
Ghoulish Gamble Advertisement, written by Strictly Slots, published in Nov. 2000.
Gold Fever Advertisement written by Atronic Casino Technology, Ltd., published 1999.
Good Times Advertisement, written by IGT, published in 1999.
Jackpot Party Advertisements, written by WMS Gaming, Inc., published in 1998.
Jewel in the Crown Advertisement, written by Barcrest Ltd., published in 1999.
Spin Till You Win Game Description written by IGT, published in 1996.
The Game Series Diamond Mine Advertisement, written by IGT, published prior to 2004.
Top Dollar Advertisement, written by IGT, published in 1998.
Triple Bucks Advertisement, written by IGT, published in 1999.
Wild Bear Salmon Run Advertisement written by IGT, published in 2003.
Winning Bid Advertisement, written by WMS Gaming Inc., published prior to Jan. 2001.
Roaring 20's article, written by Frank Legato, published in Strictly Slots, Aug. 2008.

* cited by examiner

FIG. 4

| Spin (124) | Result of Spin (126) |
|---|---|
| 1 | 10 |
| 2 | 5 |
| 3 | 200 |
| 4 | 0 |
| 5 | TRACKING |
| 6 | 25 |
| 7 | 50 |
| 8 | 1000 |
| 9 | BACK |
| 9a (Repeat of 8) | *1000* |
| 9b (Repeat of 7) | *50* |
| 9c (Repeat of 6) | *25* |
| 9d (Repeat of 5) | *TRACKING* |
| 10 | 100 |
| 11 | TRACKING |
| 12 | 25 |
| 13 | 250 |
| 14 | 0 |
| 15 | BACK BACK |
| 15a (Repeat of 14) | *0* |
| 15b (Repeat of 13) | *250* |
| 15c (Repeat of 12) | *25* |
| 15d (Repeat of 11) | *TRACKING* |
| 15e (Repeat of 10) | *100* |
| 15f (Repeat of 9) | *BACK - 1075* |
| 15g (Repeat of 8) | *1000* |
| 15h (Repeat of 7) | *50* |
| 15i (Repeat of 6) | *25* |
| 15j (Repeat of 5) | *TRACKING* |
| | |
| End Game | |

FIG. 5

| Spins (118) | Tracking Symbol Probability (120) | Back Symbol Probability (122) |
|---|---|---|
| 0 → 10 | 100 % | 0 % |
| 11 → 15 | 75 % | 25 % |
| 16 → 30 | 50 % | 50 % |
| 31 → 40 | 25 % | 75 % |
| 40 → 60 | 10 % | 90 % |
| 61 → 80 | 80 % | 20 % |

FIG. 7

| 140 Spin | 142 Result of Spin |
|---|---|
| 1 | 5 |
| 2 | 10 |
| 3 | 0 |
| 4 | 200 |
| 5 | 20 (Future Symbol Generated) |
| 6 | 15 |
| 7 | 0 |
| 8 | 10 (Back 3 Symbol Generated) |
| 8a (Repeat of 7) | 0 |
| 8b (Repeat of 6) | 15 |
| 8c (Repeat of 5) | 20 (Future Symbol Generated) |
| 9 | 20 |
| 10 | 5 |
| 11 | 25 |
| 12 | 10 (Back 2 Symbol Generated) |
| 12a (Repeat of 11) | 25 |
| 12b (Repeat of 10) | 5 |
| End Game | Total = 385 |

FIG. 8

| 144 | 146 Spin | 148 Result of Spin |
|---|---|---|
| 1X Present Generation Mode | 1 | 10 (1x10) |
| | 2 | 0 (1x0) |
| | 3 | 50 (1x50) |
| | 4 | 5 (1x5) - Into the Future Symbol Generated |
| | 5 | 20 (1x20) |
| | 6 | 5 (1x5) - Back 2 Symbol Generated |
| 2X Regeneration Mode | 6a (Repeat of 5) | 40 (2x20) |
| | 6b (Repeat of 4) | 10 (2x5) - Into the Future Symbol Regenerated |
| 3X Future Generation Mode | 7 | 45 (3x15) |
| | 8 | 30 (3x10) |
| | 9 | 0 (3x0) - Present Mode Symbol Generated |
| 1X Present Generation Mode | 10 (Repeat of 7) | 15 (1x15) |
| | 11 (Repeat of 8) | 10 (1x10) |
| | 12 (Repeat of 9) | 0 (1x0) - Present Mode Symbol Regenerated |
| | End Game | Total=250 |

GAMING DEVICE HAVING SEQUENTIAL ACTIVATIONS OF A GAME AND REPLAY OF PREVIOUS ACTIVATIONS OF THE GAME

PRIORITY CLAIM

This application is a continuation patent application of, claims priority to and the benefit of U.S. patent application Ser. No. 10/956,508, filed on Oct. 1, 2004, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufacturers strive to make gaming devices that provide as much enjoyment and excitement as possible. Providing a game in which a player has an opportunity to win multiple awards and potentially large awards or credits are ways to enhance player enjoyment and excitement. Currently, gaming devices provide games, such as slot games, wherein a player has one or more opportunities to obtain a winning symbol combination on mechanical or video reels. In these gaming devices, the player initiates an activation or spin of the reels by making a wager and the positions of the stopped reels determines whether a player wins a value credits and if so, how many credits the player wins. In these gaming devices, regulations require that the results or outcomes of one or more of the previous spins are stored in a memory device. The storing of the outcomes enables a regulator or gaming device operator, such as casino personal, to access the results of a predetermined number of previous plays or spins in order to monitor game play. On many known slot machines, the previous ten outcomes are stored in a memory device, however, this number can vary.

Certain known gaming devices have one or more free spin modes or sequences which are provided to the player after a triggering event in a primary game. The triggering event temporarily halts the primary game play and enables a player to enter a free spin mode or sequence wherein one or more free spins are provided to the player. The player plays the free spin mode or sequence, likely receives an award during one or more of the free spins and returns to the base game. Free spin mode or sequences that provide players with large awards or the potential to win large awards are attractive to players.

Certain known gaming devices utilize a memory device to flag information from one game or gaming sequence to be regenerated in one or more subsequent games or gaming sequences. One known gaming device uses a memory device to store one or more symbols generated from a spin of the reels for subsequent use, such as in the next spin. Another one of these gaming devices allows the player to select a symbol to save and then allows the player to retrieve this symbol in a subsequent game or gaming sequence. These games attempt to enhance the player experience by allowing the outcome of one game to influence the outcome of a subsequent game.

Additionally, other known gaming devices utilize a memory device and a history display to display the results of previous spins or activations to the player. One of these gaming devices shows the time interval since the last occurrence of a particular outcome or the frequency of the occurrence of a particular outcome. These games attempt to entice a player to play a gaming device that they perceive is "hot," or one that is ready to "hit."

To increase player enjoyment and excitement, it is desirable to provide players with new features for gaming devices, where the new features utilize a memory device to regenerate, redisplay and award players the outcomes of one or more previous plays of the game.

SUMMARY OF THE INVENTION

The present invention provides a gaming device that stores, flags or tracks the game outcomes of at least one and preferably a plurality of independent plays of a game of a gaming device, such as a primary game. The flagged game outcomes are subsequently regenerated or replayed for the player in one or more subsequent plays of the gaming device. In one embodiment, upon a suitable tracking triggering event, such as the generation of a specific symbol in a slot game or a specific card or hand of cards in a card game, the gaming device stores, flags or tracks one or more outcomes in a designated area of a memory device. In this embodiment, upon the occurrence of a suitable replay triggering or regeneration event, such as the generation of a specific symbol in a slot game or a specific card or hand of cards in a card game, the gaming device retrieves one or more of the outcomes flagged in the designated area of the memory device. The gaming device regenerates or replays the retrieved flagged outcomes and provides a player with one or more awards based on the regenerated flagged outcomes.

In one embodiment, the gaming device includes a plurality of symbol displays or generators, such as reels. Each symbol display or generator includes a plurality of symbols. In one embodiment, at least one and preferably a plurality of the symbols or symbol combinations are designated as tracking or flagging symbols. A tracking or flagging symbol is a symbol that, when generated by the symbol generators, causes the gaming device to track or flag the outcome of the current symbol generation and/or one or more subsequent symbol generations in a designated area of the memory device. Additionally, in one embodiment, at least one and preferably a plurality of the symbols or symbol combinations are designated as back or replay symbols. A back or replay symbol is a symbol that, when generated by the symbol generators, causes the gaming device to retrieve and regenerate one or more of the previously generated tracked or flagged outcomes.

In another embodiment, rather than designated tracking and back symbols, one or more symbols or symbol combinations are associated with a tracking condition. In this embodiment, upon a tracking condition occurring, the gaming device tracks or flags the outcome of the current symbol generation and/or one or more subsequent symbol generations in a designated area of the memory device. In another embodiment, one or more of the symbols or symbol combinations are associated with a back condition. In this embodiment, upon a back condition occurring, the gaming device retrieves and regenerates one or more of the previously generated tracked or flagged outcomes.

In one embodiment, the present invention can be employed in conjunction with one or more primary games slot games. In this embodiment, each time the symbol generators are activated, the player must place one or more separate wagers. In another embodiment, the present invention can be employed in association with free spins or free activations of the symbol generators. In this embodiment, the player is provided a number of free spins or free activations of the symbol generators and the game proceeds until a predetermined number of free spins, such as zero, remain or a terminating event or condition occurs and the free spin mode or sequence ends. In another embodiment, the present invention can be employed in conjunction with one or more other primary games, such as blackjack, poker, keno or any other suitable primary game.

In one embodiment, upon a suitable triggering event, the symbol generator generates a plurality of symbols. The gaming device determines an outcome, such as a win $5 or a lose outcome, based on the generated symbols and provides the player the determined outcome.

In addition to providing the player the outcome associated with the generated symbols, the gaming device also determines if a tracking or flagging symbol is generated on the reels. If a tracking symbol is generated, the gaming device tracks, flags or stores suitable outcome data related to the determined outcome in a designated area of the memory device. In different embodiments, the stored outcome data is the determined outcome, the generated symbols and/or any other suitable outcome data. In one embodiment, the designated area is a predetermined allocation of the memory device. In another embodiment, the designated area is a separate memory device altogether from the main memory device.

In one embodiment, the generation of a tracking symbol causes the gaming device to store outcome data relating or corresponding to the determined outcome in the designated area of the memory device. In another embodiment, the generation of a tracking symbol causes the gaming device to store outcome data relating or corresponding to the outcomes determined from one or more subsequent generations in the designated area of the memory device. In another embodiment, the generation of a tracking symbol causes the gaming device to store outcome data relating or corresponding to the currently determined outcome and the outcomes determined from one or more subsequent generations in the designated area of the memory device.

The gaming device also determines if a back or replay symbol is generated on the reels. If a back symbol is generated and at least one previously generated outcome is flagged in the designated area of the memory device (i.e., from the previous generation of a tracking symbol), the gaming device regenerates the outcome data relating to one or more of the previously generated flagged outcomes. In one embodiment, based on the flagged outcome data, the gaming device displays the regenerated outcome to the player and provides the regenerated outcome to the player again. Thus, upon generation of a back symbol, the gaming device regenerates one or more previously generated flagged outcomes and provides the player with the regenerated outcomes. It should be appreciated that the present invention flags generated outcomes and regenerates the flagged outcomes independent of and without regard to the nature or value of the generated outcomes. For example, if a tracking symbol has been generated and the gaming device is flagging each subsequently generated outcome, the gaming device does not distinguish if the subsequently flagged and regenerated outcomes are lose outcomes or win outcomes.

If a back or replay symbol is generated and at least one previously generated outcome is not flagged in the designated area of the memory device, then, in one embodiment, the generated back symbol functions as a wild symbol. In another embodiment, the generated back symbol functions as a multiplier. In another embodiment, the generated back symbol functions as a terminator or in any other suitable manner.

In one embodiment, the regeneration sequence includes the gaming device retrieving the flagged outcome data or flagged outcomes from the designated area of the memory device and regenerating or replaying the flagged outcomes or flagged outcome data for the player. In one embodiment, during the regeneration sequence, the gaming device regenerates outcomes until one or more outcomes that includes at least one tracking symbol or at least one back symbol are regenerated. In another embodiment, the number of flagged outcomes regenerated could be predetermined, randomly determined, determined based on the player's wager in the primary game, determined from the occurrence of one or more symbols or determined based on any other suitable manner. In one embodiment, after the regeneration of one or more previously determined flagged outcomes, the flags are removed from the regenerated outcomes in the designated area of the memory device. Once a flag is removed from a regenerated outcome, that outcome will not be regenerated again unless that outcome is subsequently flagged again.

If a tracking symbol or a back symbol is not generated, the gaming device determines if the determined outcome should be flagged in the designated area of the memory device (i.e., from a previous generated tracking symbol which causes one or more subsequent generations to be flagged in the designated area of the memory device). If the gaming device determines that the determined outcome should be flagged in the designated area of the memory device, the gaming device flags the determined outcome in the designated area of the memory device. If the gaming device determines that the determined outcome should not be flagged in the designated area of the memory device, the gaming device terminates the game (i.e., if the present invention is employed as a primary game) or continues to the next free spin, if available (i.e., if the present invention is employed as a free spin mode or sequence).

In one embodiment wherein the present invention is employed in association with free spins or free activations of the symbol generators, each regeneration of a previously flagged outcome reduces the number of free spins remaining. In another embodiment, each regeneration of a previously flagged outcomes does not reduce the number of free spins remaining. In another embodiment wherein the present invention is employed in association with a free spin mode or sequence, upon the generation of a back symbol the free spin mode or sequence ends. In another embodiment, upon the generation of a back symbol, the game play continues until no free spins are remaining. In another embodiment, the game ends upon the generation of a predetermined number of back symbols, tracking symbols or any other suitable symbol. In an alternative embodiment, the game ends upon the generation of multiple tracking symbols before the generation of a back symbol. Furthermore, in another embodiment, the game ends upon the generation of a terminal symbol or upon the occurrence of any suitable terminating event, that indicates that the flagged outcomes in the memory device will be removed.

In an alternative embodiment, the gaming device enables the player to select at least one flagged outcome that, upon the generation of a back symbol, the gaming device will sequentially regenerate back to before terminating the regeneration sequence. For example, the gaming device could allow the player to choose to regenerate outcomes until a plurality of previously flagged tracking symbol outcomes are regenerated. In one embodiment, the gaming device would regenerate all of the flagged outcomes until the selected tracking symbol outcome is regenerated. In another embodiment, the gaming device would only regenerate the outcomes flagged after the selected tracking symbol was generated. In this embodiment, the flagged outcomes are grouped and the player is enabled to select one or more groups of flagged outcomes for the gaming device to regenerate upon the generation of one or more back symbols.

Another embodiment of the gaming device does not require that the gaming device first generate a tracking symbol before the outcomes are flagged. In this embodiment, the plurality of symbols only include at least one and preferably a plurality of back symbols and not any tracking or flagging symbols. This embodiment is played as described above, however, the gaming device skips the steps of determining if a tracking symbol is generated and proceeds with determining if a back symbol is generated. In this embodiment, if a back symbol is generated, the gaming device regenerates or replays one or more of the previously determined outcomes which are automatically flagged in the designated area of the memory device.

In another embodiment employed in association with free spins or free activations of the symbol generators, each of the generated outcomes (or outcome data relating to each of the generated outcomes) are automatically marked, flagged or stored in a designated area of the memory device. In this embodiment, at least one and preferably a plurality of the symbols are designated as future or advance symbols. A future or advance symbol is a symbol that, when regenerated by the symbol generators during a regeneration sequence, causes the gaming device to exit the regeneration sequence and return to the pre-regeneration sequence free spin mode.

In operation of this embodiment, if a back symbol is generated, the gaming device initiates the regeneration sequence and regenerates or replays one or more of the previously determined outcomes which are automatically flagged in the designated area of the memory device. For each regenerated outcome, the gaming device determines if a future symbol is regenerated.

If a future symbol is not regenerated and at least one previously generated outcome remains flagged in the designated area of the memory device, the gaming device proceeds in regenerating another one of the previously generated outcomes which are flagged in the designated area of the memory device. If a future symbol is not regenerated and no previously generated outcomes remain flagged in the designated area of the memory device, the gaming device terminates the free spin mode or sequence. That is, the generation of a back symbol without the subsequent regeneration of a future symbol causes the end of the free spin mode or sequence.

On the other hand, if a future symbol is generated, the gaming device exits the regeneration sequence and returns to the free spin sequence of the pre-regeneration sequence free spin mode. In other words, in this embodiment, each back or replay symbol functions as a terminator of the free spin or free activation mode and each future or advance symbol functions as an anti-terminator to the free spin mode or sequence terminating effect of a generated back symbol.

The gaming device of the present invention increases player enjoyment by providing the player an opportunity to have their winnings increased substantially because they are provided individual outcomes or awards more than one time. That is, by providing players with new reel features wherein the new features involve a regeneration of previous outcomes, the gaming device of the present invention provides the player with a more exciting gaming experience.

Additional features and advantages of the present invention are described in and will be apparent from, the following Detailed Description of the Invention and the figures.

BRIEF DESCRIPTION OF THE FIGURES

FIG. 4 is a table illustrating the results of a number of symbol generations of one embodiment of the present invention including back symbols and tracking symbols.

FIG. 5 is a table showing a number of probabilities of generating a tracking or back symbol based upon the number of spins.

FIG. 7 is a table illustrating the results of a number of symbol generations of an alternative embodiment of the present invention which includes back symbols and future symbols.

FIG. 8 is a table illustrating the results of a number of symbol generations of an alternative embodiment of the present invention which includes a present generation mode, a regeneration mode and a future generation mode.

DETAILED DESCRIPTION OF THE INVENTION

Figure 1A:
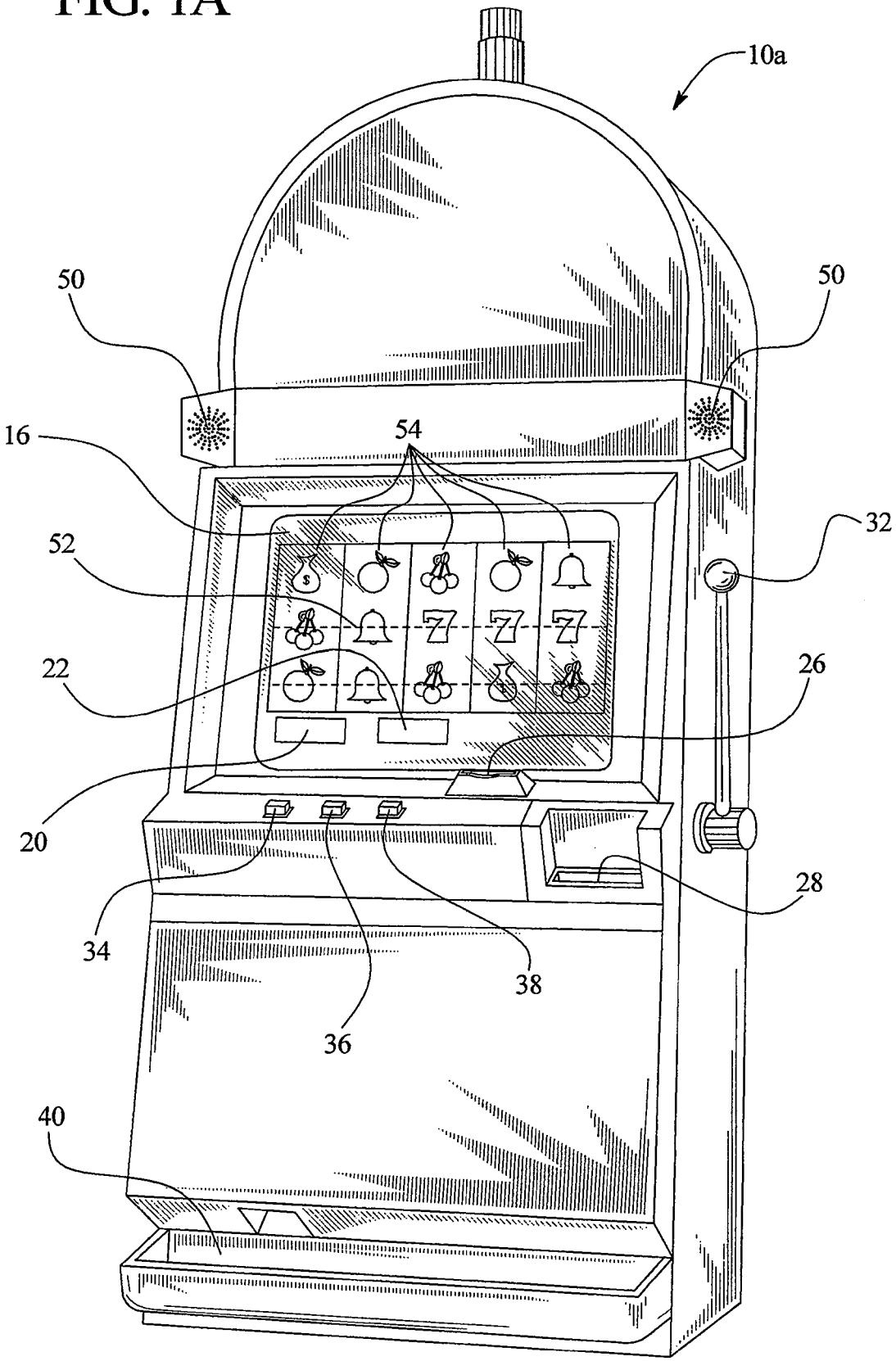
FIG. 1A is a front-side perspective view of one embodiment of the gaming device of the present invention.
Figure 1B:
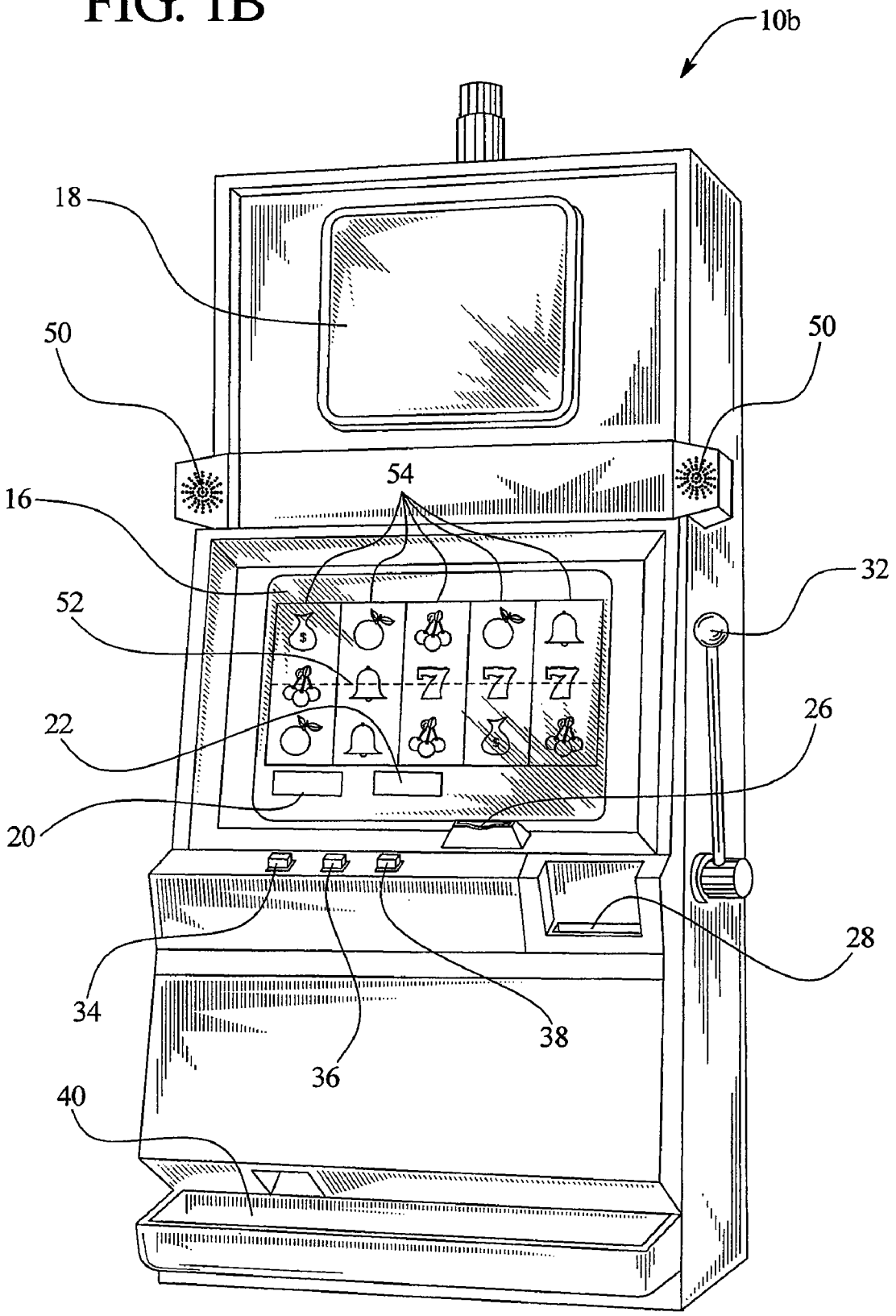
FIG. 1B is a front-side perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
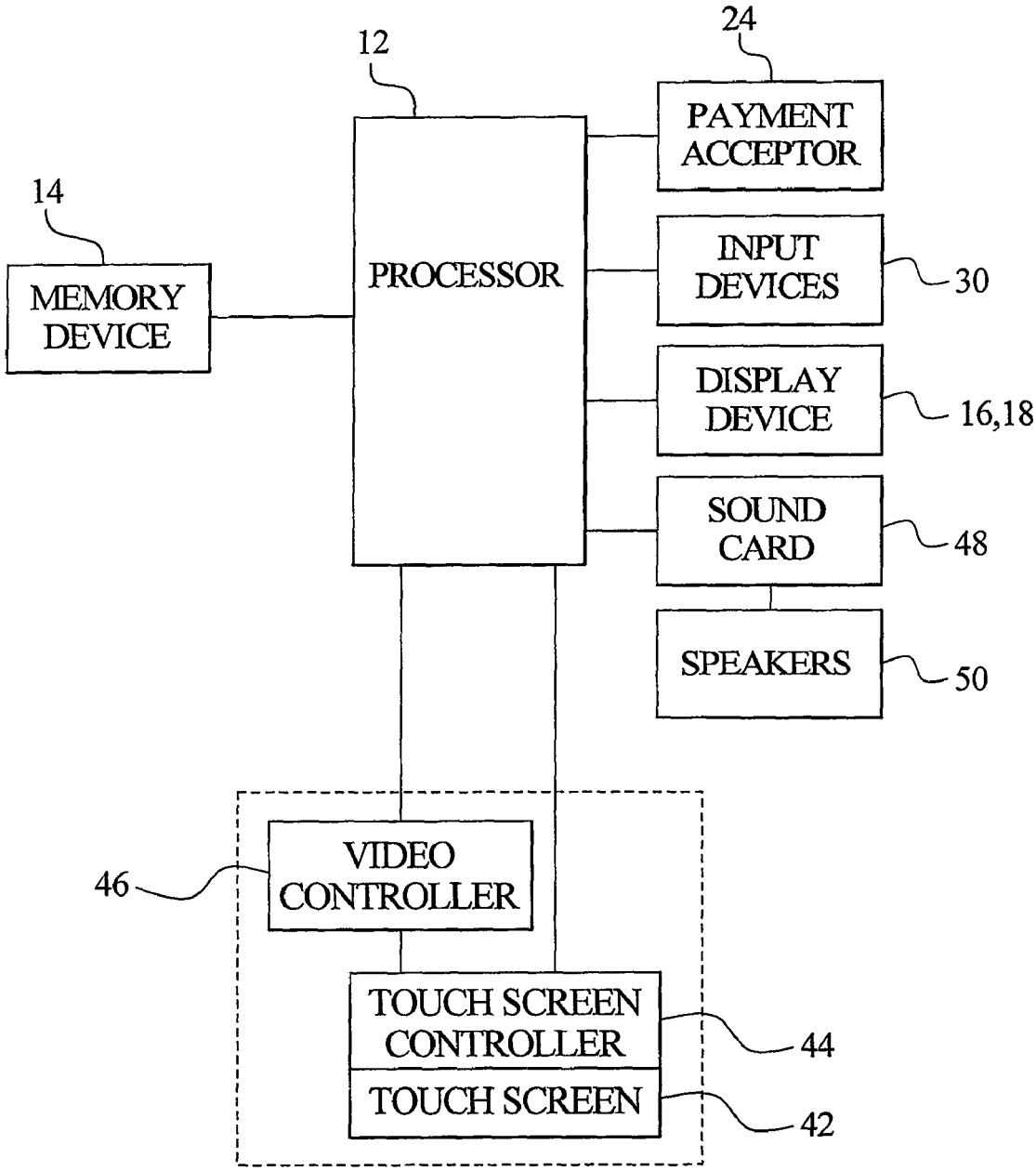
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. As described in more detail below, the memory device also stores outcome data relating or corresponding to one or more generated outcomes. In different embodiments, the outcome data relates to any previously generated outcomes, any symbols associated with the previously generated outcomes or any other suitable outcome data.

In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be flagged in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates game outcomes, such as awards, based on probability data. That is, each game outcome is associated with a probability and the gaming device generates the game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of game outcomes, such as awards. In this embodiment, as each game outcome is provided to the player, the gaming device removes the provided game outcome from the predetermined set or pool. Once removed from the set or pool, the specific provided game outcome cannot be provided to the player again (i.e., unless during a subsequent regeneration of a previously flagged outcome as described in more detail below). In one embodiment, each outcome stored in the set or pool of game outcomes is displayed to the player as the initial generation of an outcome coupled with the subsequent regeneration of the outcome. For example, a game outcome of win $10 may be displayed to the player as an initial generation of a win $5 outcome and also as a subsequent regeneration of the win $5 outcome to total the win $10 outcome that was removed from the set or pool of game outcomes. This type of gaming device provides players with all of the available game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables at least a portion of the primary or secondary game to be played at a location remote from the gaming device. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into the present invention.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active payline or otherwise occur in a winning pattern.

In one embodiment, a base or primary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and replacement cards are dealt from the remaining cards in the deck. This results in a final five-card hand. The final five-card hand is compared to a payout table which utilizes conventional poker hand rankings to determine the winning hands. The player is provided with an award based on a winning hand and the credits the player wagered.

In another embodiment, the base or primary game may be a multi-hand version of video poker. In this embodiment, the player is dealt at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, as described in more detail below, the bonus game may consist of one or more regenerations of previously generated outcomes. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game, rather they must win or earn entry through play of the primary game and thus, play of the primary game is encouraged. In another embodiment, qualification of the bonus or secondary game could be accomplished through a simple "buy in" by the player if, for example, the player has been unsuccessful at qualifying through other specified activities.

Figure 2B:
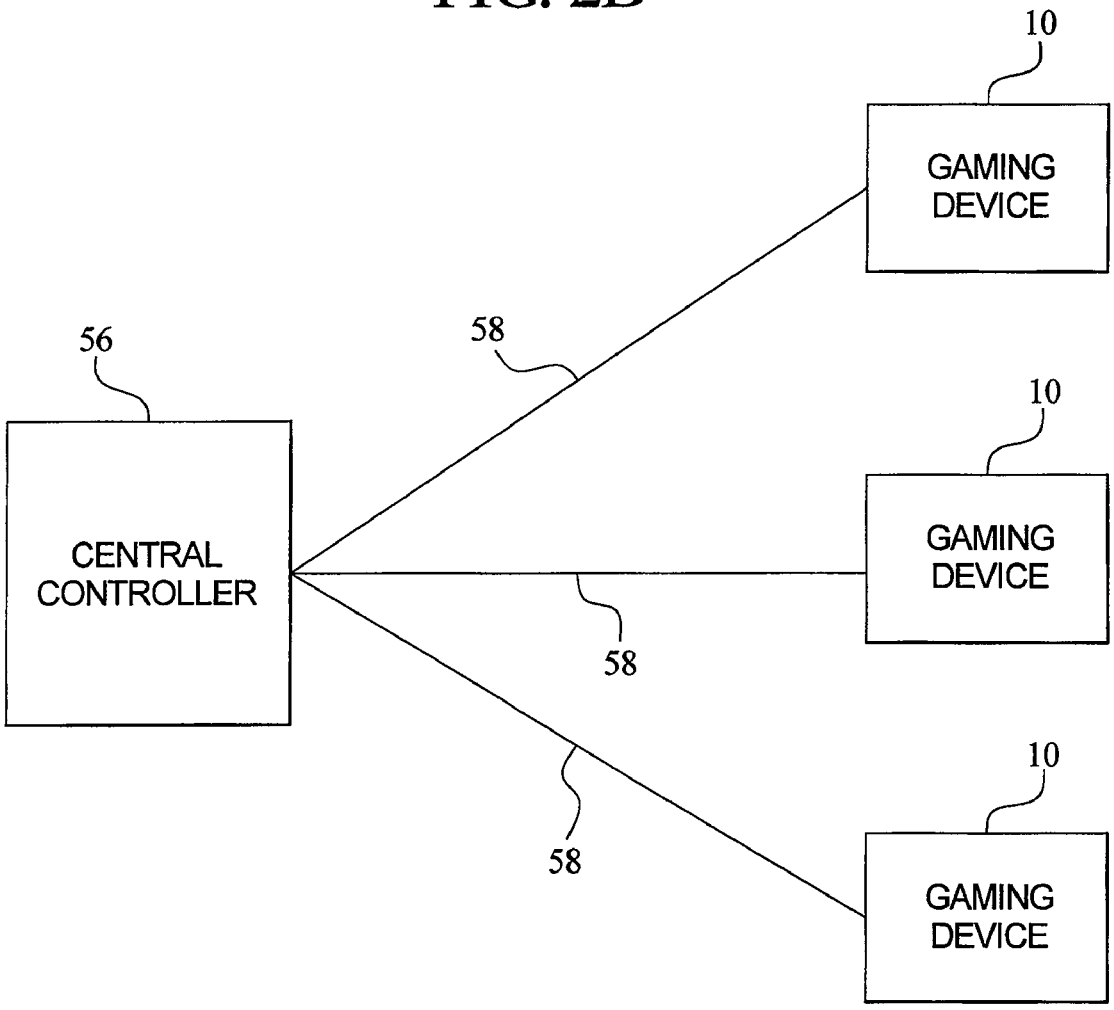
FIG. 2B is a schematic block diagram illustrating a plurality of gaming terminals in communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, an initial generation of a game outcome coupled with any subsequent regenerations of that game outcome or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable or other suitable connection. In this embodiment, players may access an internet game page from any location where an internet connection and computer or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event outcomes or awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to and receive information from, the host site computer. Each central server computer is responsible for all data communication between the gaming device hardware and software and the host site computer.

Sequential Activations and Replay of Previous Activations

Figure 3A:
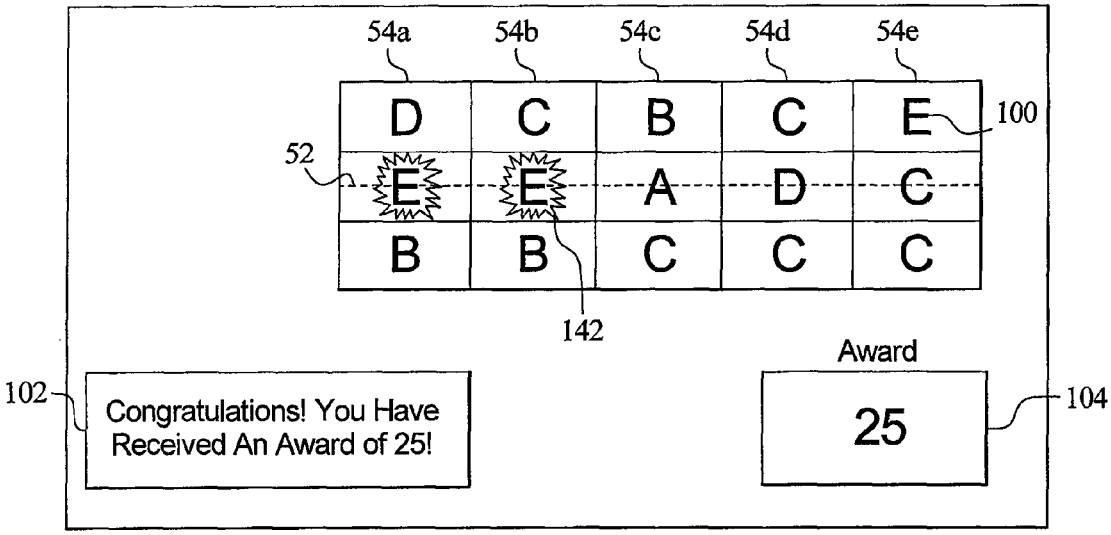
FIGS. 3A, 3B, 3C, 3D, 3E, 3F, 3G and 3H are top plan views of one embodiment of the present invention illustrating a plurality of symbol generations and symbol regenerations.

Referring now to FIG. 3A, the gaming device provides a plurality of symbol generators or displays, such as reels 54*a*, 54*b*, 54*c*, 54*d* and 54*e*. Each symbol generator or display includes a plurality of symbols 100. In one embodiment of the present invention illustrated in association with a plurality of plays of a primary game, upon a player placing a wager, the reels spin to generate a plurality of symbols. The gaming device determines an outcome, such as an award or value, based on a symbol or combination of symbols generated on an active payline 52 of the reels. As seen FIG. 3A, an outcome of an award of twenty-five was determined and provided to the player based on the combination of symbols generated along the active payline. An award display 104 indicates the value of the award provided to the player. After determining an outcome based on the generated symbols, the gaming device determines if a tracking event or a regenerating event occurs. In one embodiment, the gaming device determines if a tracking symbol or back symbol is generated on the reels.

In one embodiment, the plurality of symbol generators include at least one tracking symbol. In another embodiment, the plurality of symbol generators includes a plurality of tracking symbols. In another embodiment, each of the plurality of symbol generators include at least one tracking symbol. In another embodiment, each of the plurality of symbol generators include a plurality of tracking symbols. In different embodiment, the number of tracking symbols may be predetermined, randomly determined, determined based on a wager or determined based on any other suitable manner.

In one embodiment, the plurality of symbol generators include at least one back symbol. In another embodiment, the plurality of symbol generators includes a plurality of back symbols. In another embodiment, each of the plurality of symbol generators include at least one back symbol. In another embodiment, each of the plurality of symbol generators include a plurality of back symbols. In different embodiment, the number of back symbols may be predetermined, randomly determined, determined based on a wager or determined based on any other suitable manner.

In this example, since no tracking symbol or back symbol is generated, the gaming device determines if the determined outcome should be flagged in the designated area of the memory device (i.e., from a previously generated tracking symbol which causes one or more subsequent generations to be flagged in the designated area of the memory device). In this case, as the determined outcome should not be flagged (i.e., there are no previously determined outcomes flagged in the designated area of the memory device), the gaming device terminates the primary game sequence without flagging or tracking the currently determined outcome in a designated area of the memory device. An appropriate message such as "CONGRATULATIONS! YOU HAVE RECEIVED AN AWARD OF 25" can be provided to the player visually, or through suitable audio or audiovisual displays.

Figure 3B:
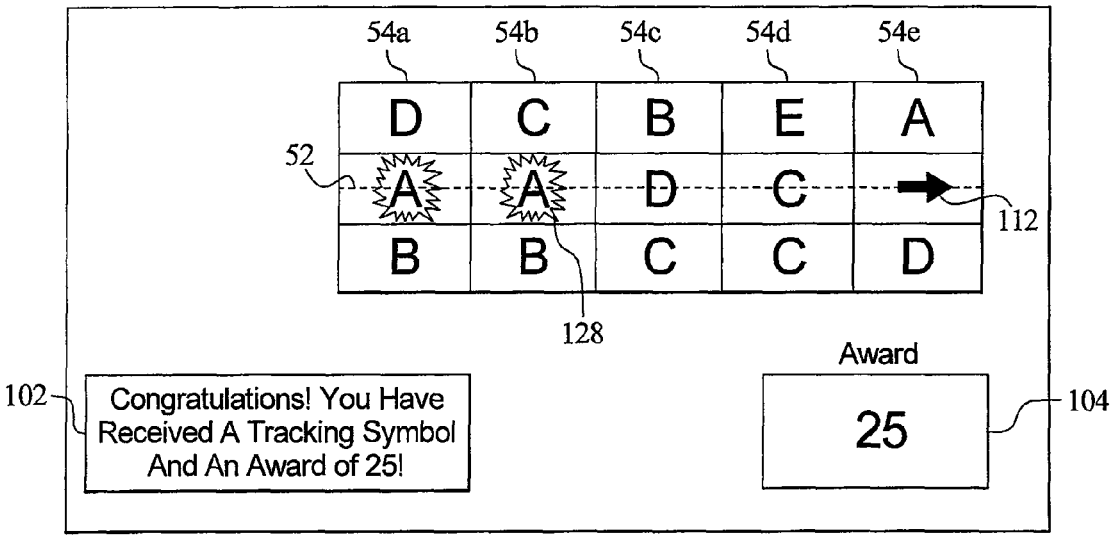

Referring to FIG. 3B, upon the player placing another wager, the reels spin a second time to generate another plurality of symbols. The gaming device again determines an outcome based on a symbol or combination of symbols generated on an active payline of the reels. As seen FIG. 3B, an outcome of an award of twenty-five was determined and provided to the player based on the combination of symbols generated along the active payline. Additionally, the gaming device determines if a tracking symbol or back symbol is generated on the reels. The tracking symbol 112, which is represented by a "→," is generated on the fifth reel 54*e* and the gaming device flags the outcome of the current symbol generation in a designated area of a memory device for later retrieval and regeneration. It should be appreciated that the outcome flagged in the designated area may include a plurality of generated symbols and/or the awards associated with those symbols. An appropriate message such as "CONGRATULATIONS! YOU HAVE RECEIVED A TRACKING SYMBOL AND AN AWARD OF 25" can be provided to the player visually, or through suitable audio or audiovisual displays.

In one embodiment, the generation of a tracking symbol causes the gaming device to flag the determined outcome in the designated area of the memory device. In another embodiment, the generation of a tracking symbol causes the gaming device to flag the outcomes determined from one or more subsequent generations in the designated area of the memory device. In another embodiment, the generation of a tracking symbol causes the gaming device to flag the currently determined outcome and the outcomes determined from one or more subsequent generations in the designated area of the memory device.

In one embodiment, the gaming device tracks, flags or stores suitable outcome data related to the determined outcome in a designated area of the memory device. In one embodiment, the stored outcome data includes the gaming device storing or flagging the determined outcome and the generated symbols that are associated with the determined outcome. In this embodiment, upon a regeneration event, the gaming device regenerates the flagged symbols which correspond with the regenerated outcome. In another embodiment, the stored outcome data includes the gaming device storing or flagging the determined outcome and not the generated symbols that are associated with the determined outcome. In this embodiment, upon a regenerating event, the gaming device regenerates one or more of the flagged outcomes and displays to the player a symbol or symbol combination which is associated with the regenerated flagged outcome. It should be appreciated that in this embodiment, the regenerated symbols displayed to the player may not correspond with the symbols initially displayed to the player as associated with the initially flagged outcome. In another embodiment, the stored outcome data includes the gaming device storing or flagging the generated symbols and not the determined outcome associated with the generated symbols. In this embodiment, upon a regeneration event, the gaming device regenerates the flagged symbols and determines an outcome which corresponds with the regenerated symbols. It should be appreciated that in this embodiment, the determined outcome which corresponds with the regenerated symbols will correspond to the outcome which was not initially flagged. In another embodiment, the stored outcome data includes any suitable data or information which relates or corresponds to the generated outcome. In one example of this embodiment, upon a regeneration event, the gaming device displays a table summarizing the regenerated outcomes and provides the regenerated outcomes to the player. In another example of this embodiment, upon a regeneration event, the gaming device displays a reproduction of one or more previously displays screen shots and provides the regenerated outcomes to the player.

In one embodiment, the gaming device displays to the player one or more of the currently flagged outcomes in a separate display. In another embodiment, the gaming device periodically displays one or more of the currently flagged outcomes. In another embodiment, the gaming device does not display the currently flagged outcomes to the player.

Figure 3C:
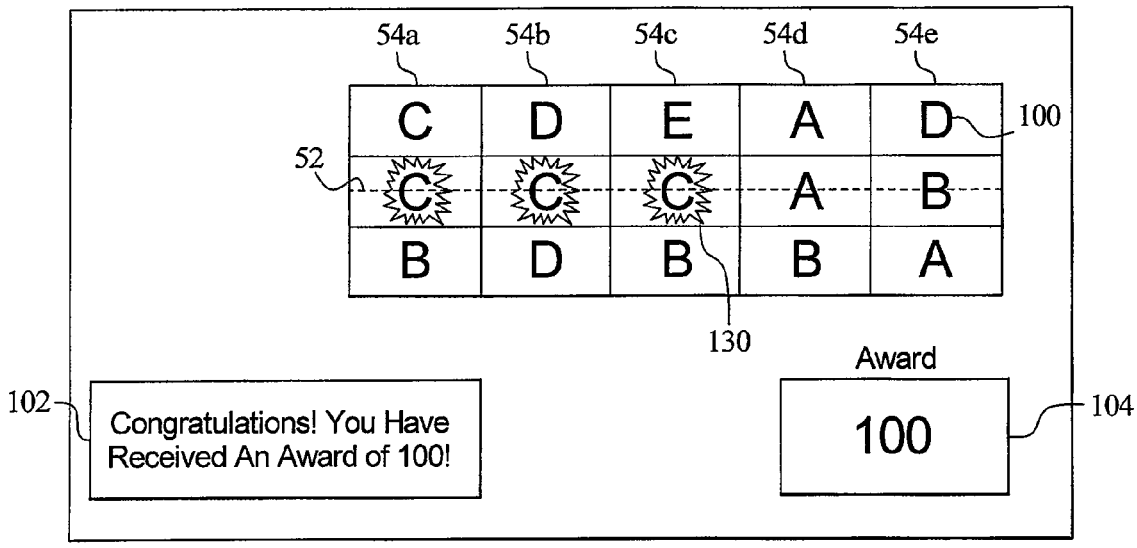

Referring to FIG. 3C, upon the player placing another wager, the reels spin a third time to generate another plurality of symbols. The gaming device again determines an outcome based on a symbol or combination of symbols generated on an active payline of the reels. As seen in FIG. 3C, an outcome of an award of one hundred is determined and provided to the player. Additionally, the gaming device determines if a tracking symbol or back symbol is generated on the reels. In this case, the gaming device determined that a tracking symbol or back symbol was not generated. Next, the gaming device determines if the determined outcome should be flagged in the designated area of the memory device (i.e., from a previously generated tracking symbol which causes one or more subsequent generations to be flagged in the designated area of the memory device). In this case, as a previously determined outcome is flagged in the designated area of the memory device, the gaming device flags the determined outcome for possible tracking regeneration and terminates the gaming sequence. An appropriate message such as "CONGRATULATIONS! YOU HAVE RECEIVED AN AWARD OF 100" can be provided to the player visually, or through suitable audio or audiovisual displays.

Figure 3D:
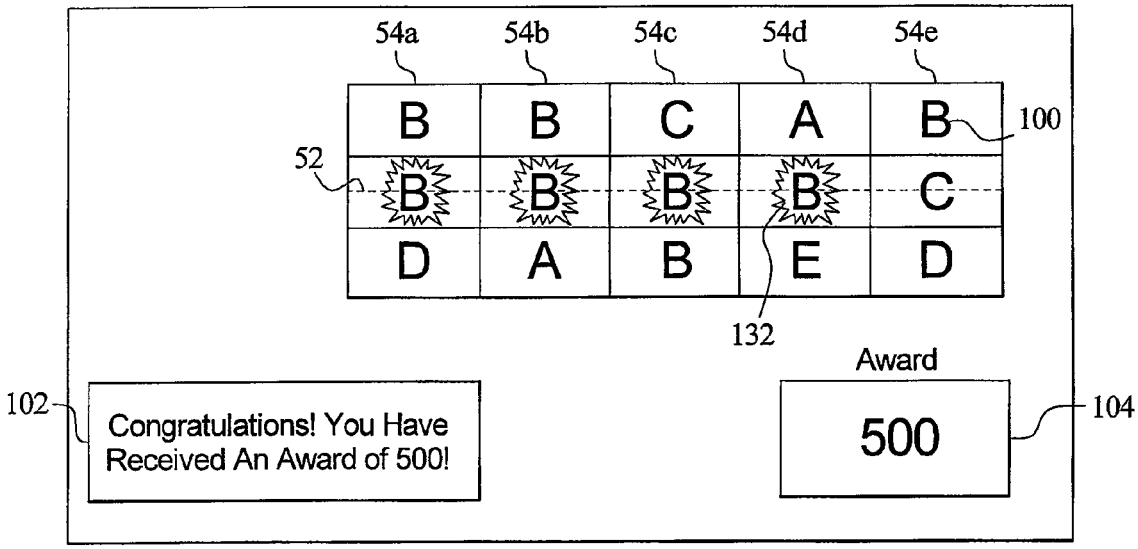

As seen in FIG. 3D, upon the player placing another wager, the reels spin a fourth time to generate another plurality of symbols. The gaming device again determines an outcome based on a symbol or combination of symbols generated on an active payline of the reels. As illustrated in FIG. 3D, an outcome of an award of five hundred is determined and provided to the player. Additionally, the gaming device determines if a tracking symbol or back symbol is generated on the reels. In this case, the gaming device determined that a tracking symbol or back symbol were not generated. Next, the gaming device determines if the determined outcome should be flagged in the designated area of the memory device (i.e., from a previously generated tracking symbol which causes one or more subsequent generations to be flagged in the designated area of the memory device). In this case, as at least one previously determined outcome is flagged in the designated area of the memory device, the gaming device flags the determined outcome for possible tracking regeneration and terminates the gaming sequence. An appropriate message such as "CONGRATULATIONS! YOU HAVE RECEIVED AN AWARD OF 500" can be provided to the player visually, or through suitable audio or audiovisual displays.

Figure 3E:
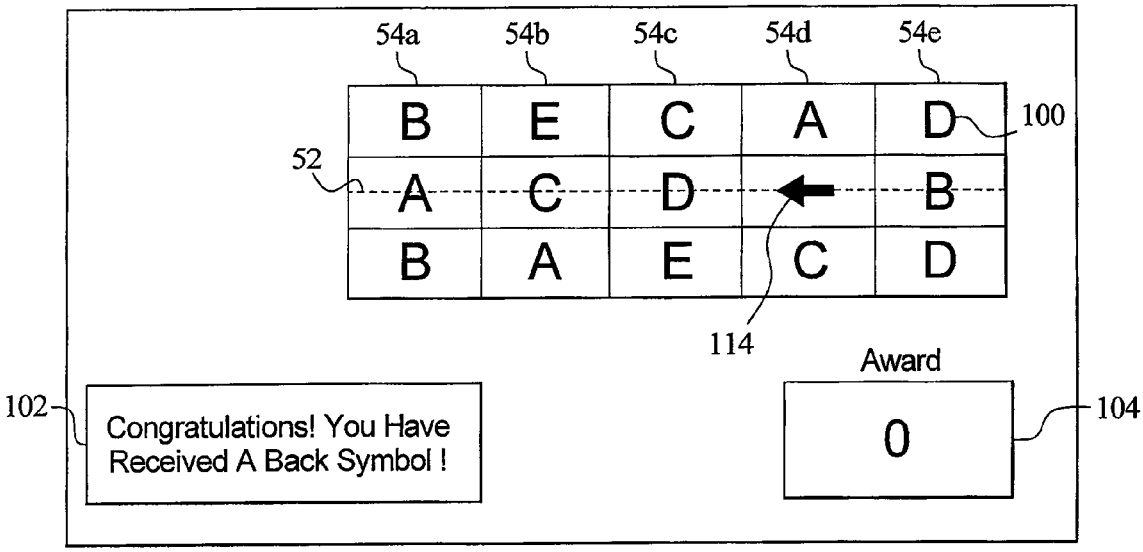
Figure 3F:
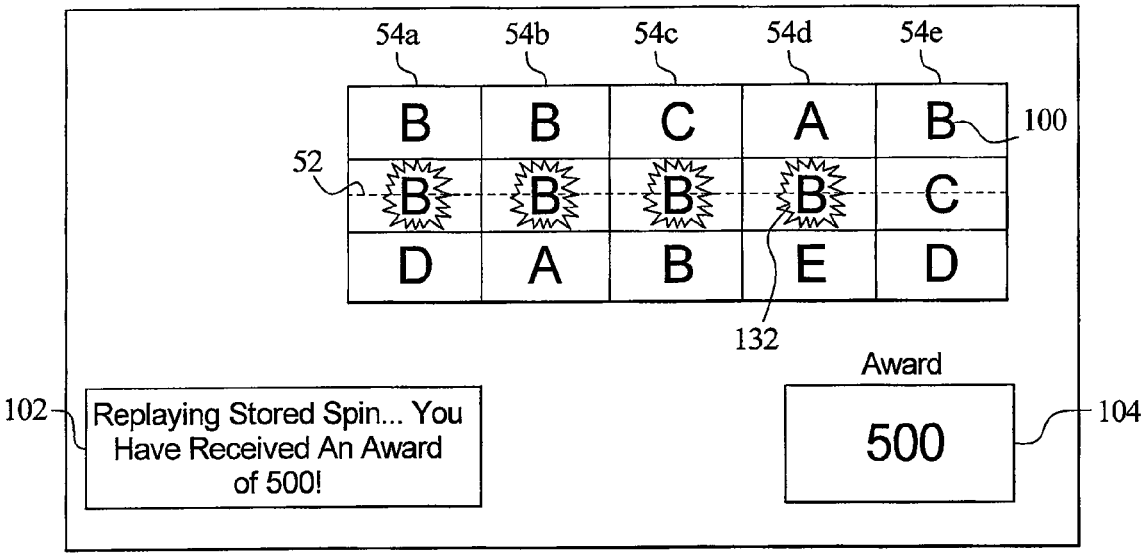
Figure 3G:
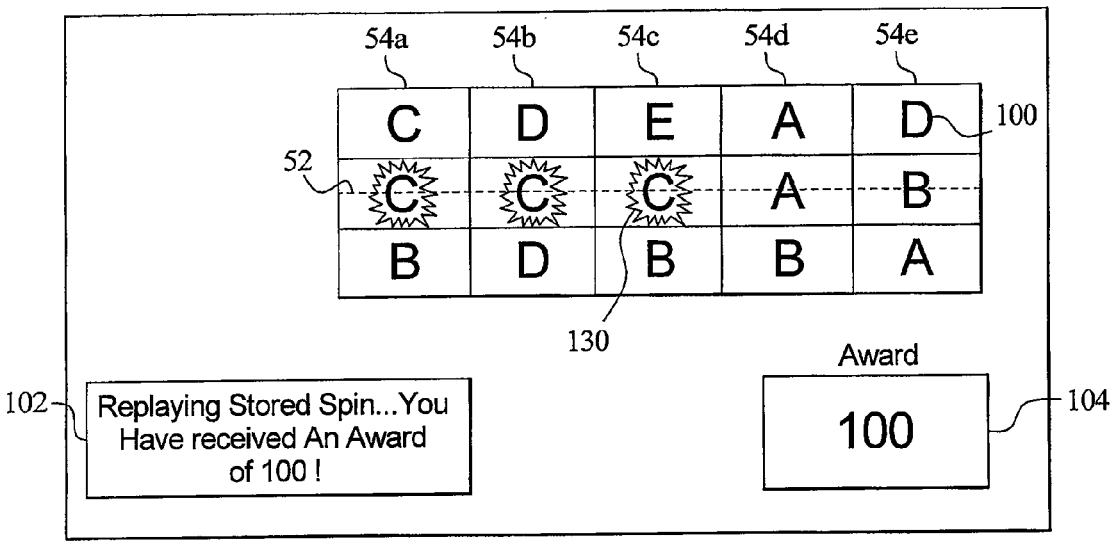
Figure 3H:
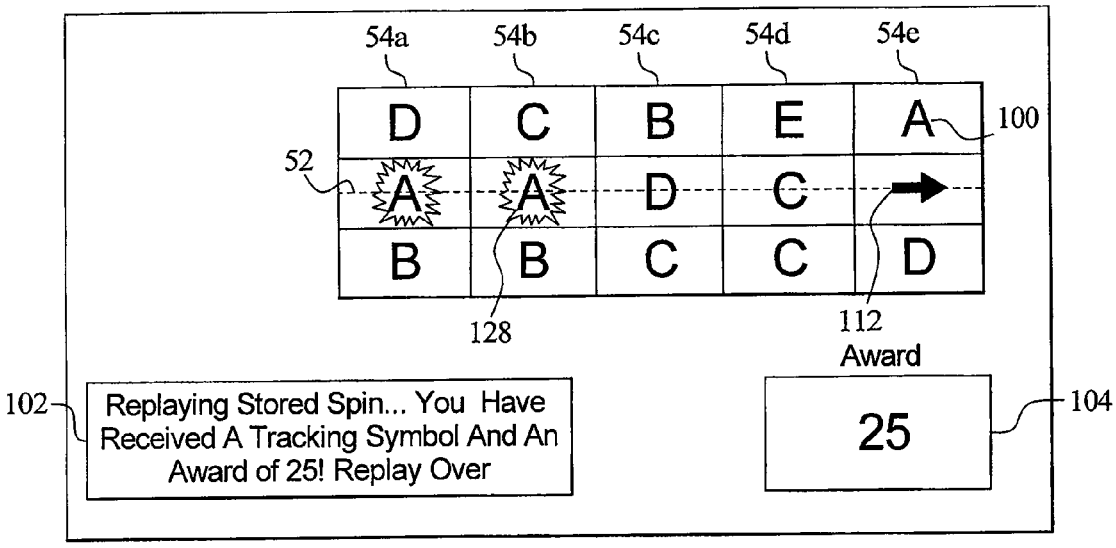

As seen in FIG. 3E, upon the player placing another wager, the reels spin a fifth time to generate another plurality of symbols. The gaming device again determines an outcome based on a symbol or combination of symbols generated on an active payline of the reels. As seen in FIG. 3E, an outcome of an award of zero is determined and thus no award is provided to the player. Additionally, the gaming device determines if a tracking symbol or back symbol is generated on the reels. In this case, the gaming device determines that a back symbol 114, represented by a "←," is generated on the fourth reel. As a back symbol is generated and at least one previously generated outcomes is flagged in the designated area of the memory device (i.e., from the previously generation of a tracking symbol illustrated in FIG. 3B), the gaming device regenerates one or more of the previously generated flagged outcomes. FIGS. 3F through 3H illustrate the regenerations. An appropriate message such as "CONGRATULATIONS! YOU HAVE RECEIVED A BACK SYMBOL" can be provided to the player visually, or through suitable audio or audiovisual displays.

In one embodiment, the regeneration sequence includes the gaming device retrieving the flagged outcomes from the designated area of the memory device and regenerating or replaying the flagged outcomes for the player. In one embodiment, during the regeneration sequence, the gaming device regenerates outcomes until one or more outcomes that includes at least one tracking symbol or at least one back symbol are regenerated. In another embodiment, the number of flagged outcomes regenerated could be predetermined, randomly determined, determined based on a wager, determined from the occurrence of one or more symbols or determined based on any other suitable manner. In one embodiment, after the regeneration of one or more previously determined flagged outcomes, the flags are removed from each of the previously flagged outcomes.

In one embodiment, the gaming device regenerates the flagged outcomes by retrieving them from the designated area of the memory device and replaying or redisplaying the flagged outcomes. In another embodiment, the regeneration may only include retrieving the flagged outcomes and providing the player with an award based on all of the retrieved flagged outcomes. In one embodiment, the gaming device also determines an additional or supplemental award based on the regenerated flagged outcomes and provides the additional or supplemental award to the player. In this embodiment, the additional or supplemental award may be determined based on the number of regenerations, the frequency of the regenerations or any other suitable manner. In another embodiment, the gaming device only regenerates flagged winning outcomes which are associated with a payout. For example, if five outcomes with awards of ten, zero, twenty, zero and five are flagged, the gaming device will regenerated the outcomes with the awards of ten, twenty and five and not regenerate the outcomes with the award of zero.

In one embodiment, the player must place a separate wager for the regeneration of one or more of the previously flagged outcomes. In another embodiment, the player must place a separate wager for the regeneration of each of the previously flagged outcomes. In another embodiment, no separate wager is necessary for the regeneration of each of the previously flagged outcomes.

In an alternative embodiment, one or more back symbols or symbol combinations are associated with a number of regenerations. In this embodiment, if a back symbol is associated with a number of regenerations, then the gaming device will regenerate a number of flagged outcomes equaling the number associated with the generated back symbol. For example, if a "back 5" symbol is generated, the gaming device will regenerate five of the previously flagged outcomes. In one embodiment, the number associated with one or more back symbols is predetermined. In another embodiment, the number associated with one or more back symbols is randomly determined. In another embodiment, the number associated with one or more back symbols is determined based on the player's wager in the primary game which triggered the back symbol. In another embodiment, the number associated with one or more back symbols is determined based on the position of the back symbol is generated on the reels.

As seen in FIG. 3F, as there is at least one flagged outcome to regenerate, the gaming device regenerates the most recently flagged outcome. In this case, the gaming device regenerated the flagged outcome associated with the generation of symbols illustrated in FIG. 3D. The processor retrieved the last flagged outcome from the designated area and regenerated or replayed the outcome for the player. In one embodiment, the flag is removed from each regenerated outcome. An outcome of an award of five hundred associated with the regenerated symbols is provided to the player. An appropriate message such as "REPLAYING FLAGGED SPIN . . . YOU HAVE RECEIVED AN AWARD OF 500" can be provided to the player visually, or through suitable audio or audiovisual displays.

In one embodiment, the processor is operable to retrieve the flagged outcomes from the memory device in a last in first out order (i.e., backward). In another embodiment, the processor is operable to retrieve the outcome from the memory device in a first in first out order (i.e., forward) It should be appreciated that the gaming device can be designed to retrieve the flagged outcomes in a random order or any suitable designated or predetermined order.

Referring to FIG. 3G, the gaming device next determines if there is at least one flagged outcomes remaining in the designated area of the memory device. Since there is at least one flagged determined outcome to regenerate, the gaming device regenerates the next flagged outcome associated with the generation of symbols illustrated in FIG. 3C. The processor retrieved the outcome generated in FIG. 3C from the designated area and regenerated or replayed the outcome for the player. An outcome of an award of one hundred associated with the regenerated symbols is provided to the player. An appropriate message such as "REPLAYING STORED SPIN. YOU HAVE RECEIVED AN AWARD OF 100" can be provided to the player visually, or through suitable audio or audiovisual displays.

Referring to FIG. 3H, the gaming device next determines if there is at least one flagged outcomes remaining in the designated area of the memory device. Since there is at least one flagged determined outcome to regenerate, the gaming device regenerates the next flagged outcome associated with the generation of symbols illustrated in FIG. 3B. The processor retrieved the outcome generated in FIG. 3B from the designated area and regenerated or replayed the outcome for the player. An award of twenty-five associated with the regenerated symbols is provided to the player. Moreover, the fifth reel 54*e* generated a tracking symbol 112 along the active payline. In one embodiment, the regeneration of a tracking symbol is a terminating event which ends the regeneration process as well as the play of the game.

The present invention can also be employed as a secondary bonus game in a gaming device. In one embodiment, the present invention is employed in accordance with a plurality of free spins or activations. In this embodiment, upon a suitable triggering event, a number of free spins or activations are provided to the player. In one embodiment, the number of free spins or activations is predetermined. In alternative embodiments, the number of free spins is randomly determined, based on the generation of one or more symbols, based the player's wager in the primary game or based on any other suitable manner of determining an appropriate number of spins. In one free spin mode or sequence embodiment, the gaming device automatically spins the reels for the player upon activation of the bonus game. However, in another embodiment, the player activates each spin of the reels.

In another embodiment, the gaming device provides for multiple flagging/regenerations loops to occur simultaneously or in an overlapping fashion. In this embodiment, if two tracking symbols are generated before any back symbols are generated, then the gaming device will flag each subsequent generated outcome until two back symbols are generated. In this embodiment, when two back symbols are generated, the gaming device will regenerate each of the previously flagged outcomes. In another embodiment, one or more tracking symbols could be associated with one or more back symbols. In this embodiment, if a tracking symbol is generated, the gaming device will flag one or more subsequently generated outcome(s) until a back symbol which is associated with the generated tracking symbol is generated. In this embodiment, if a back symbol which is not associated with the generated tracking symbol is generated, the gaming device will not regenerate the flagged outcomes but will continue flagging subsequently generated outcomes until the associated back symbol is generated.

In another embodiment, one or more back symbols and/or one or more tracking symbols function as the generation of a plurality of back symbols or tracking symbols. For example, if a "double tracking" symbol is generated, then the gaming device will flag one or more subsequently generated outcomes until two back symbols are generated. In one embodiment, a "double tracking" symbol will cause the gaming device to flag each generated outcome twice until a first back symbol is generated and then the gaming device will flag each generated outcome once until the second back symbol is generated. In this embodiment, upon the generation of the first back symbol, the gaming device regenerates each flagged outcome one time for each flag assigned to that outcome. In another embodiment, a "double tracking" symbol will cause the gaming device to flag each subsequent generated outcome until two back symbols are generated. In this embodiment, when two back symbols (or a "double back" symbol is generated), the gaming device will regenerate each of the previously flagged outcomes.

FIG. 4 is a table illustrating one free spin embodiment of the present invention wherein the number of regenerations or re-spins, after a back symbol does not subtract from the total number of free spins. In another embodiment, each regenerated flagged outcome subtracts from the number of free spins remaining. As illustrated in FIG. 4, free spin number 1 which is indicated in column 124, results in an outcome or award of ten as indicated in column 126. In this embodiment, the gaming device automatically spins the reels for spins 2 to 4 providing the player with the award for each spin. Spin number 5 results in a tracking symbol which causes the gaming device to flag the awards of the current and subsequent spins for re-spinning. The gaming device automatically spins the reels for spins 6 to 8 providing the player with the award for each spin. Spin number 9 results in a back symbol, thus triggering a re-spin. The back symbol generated in spin 9 causes the gaming device to inversely retrieve the flagged outcomes of spins 8 to 5 and to replay each spin to the player. In this embodiment, the gaming device replays the flagged spins in a last in first out order, as represented by spins 9*a* to 9*d*. The player is re-awarded each award indicated in column 126 as the flagged awards are regenerated. Thus, the player's potential total award increases dramatically upon the generation of a back symbol. The re-spin stops once the tracking symbol in spin 9*d* is generated.

The free spin mode or sequence then returns to normal free spin mode with spin 10, providing the player with an award of one hundred. The gaming device generates a tracking symbol in spin 11, thus causing the gaming device to flag the results of the current and subsequent spins in the designated area again. The gaming device automatically spins the reels for spins 12 to 14 providing the player with the award in column 126 for each spin. Spin number 15 results in two back symbols, thus triggering a regeneration event of one or more flagged outcomes. In this embodiment, the regeneration triggered by two back symbols causes the gaming device to regenerate the flagged outcomes until two tracking symbols are retrieved. Thus, the gaming device inversely regenerates spins 14 to 5 and replays each spin for or to the player, as represented by spins 15*a* to 15*j*. The player is re-awarded each award indicated in column 126 as the flagged awards are regenerated. Thus, the player's total award potentially increases dramatically upon the generation of multiple back symbols. In this embodiment, the player is provided with the awards occurring in spins 5 to 8 three times, including a large award of one thousand awarded in spin 8 and another large award of one-thousand-seventy-five in spin 15*f*.

In this embodiment, the gaming device re-spins any previously occurring re-spins upon the generation of a back symbol. For example, after the gaming device generates two back symbols in spin 15, the gaming device inversely regenerates the flagged outcomes from spin 14 to 10 and then regenerates the previously regenerated outcomes of spins 9*d* to 9*a* before regenerating spins 9 to 5. That is, the gaming device would also regenerate the re-spin, occurring after spin 9 represented by spins 9*a* to 9*d*, during the re-spin triggered by the back symbol in spin 15 and the award of one-thousand-seventy-five provided to the player in spin 15*f* represents the total award provided to the player from spins 9*a* to 9*d*.

In another embodiment, the gaming device enables the player to choose a flagged tracking or back symbol that the gaming device should sequentially regenerate back to before terminating the regeneration sequence. For example, the gaming device could allow the player to choose to regenerate outcomes until a plurality of previously flagged tracking symbols are regenerated. In one such embodiment, the gaming device would regenerate all of the flagged outcomes until the chosen tracking symbol is regenerated. In another embodiment, the gaming device would only regenerate those flagged outcomes flagged after the chosen tracking symbol and before the generation of another tracking or back symbol. In this embodiment, the flagged outcomes are grouped and each group contains the flagged outcomes occurring between various tracking and back symbol. Referring again to FIG. 4, for example, after the two back symbols are generated in spin 15, the player would be allowed to select spin 5 or spin 11, each resulting in a tracking symbol. In one embodiment, as described above, if the player chooses spin 5, the gaming device re-spins every flagged spin until the outcome in spin 5 is regenerated. In another embodiment, the gaming device would re-spin just those outcomes occurring after the chosen spin 5 and before spin 9 which contains the back symbol.

In another embodiment, the gaming device enables the player to save or hold one or more generated tracking symbols. In this embodiment, if the player designates to hold or save a generated tracking symbol, then the gaming device will not flag one or more subsequently generated outcomes until the player activates the held tracking symbol. For example, if the player holds a generated tracking symbol and the next generated outcome is a jackpot outcome, then the jackpot outcome will not be flagged and subsequently regenerated upon the occurrence of a back symbol. In another embodiment, the gaming device enables the player to save or hold one or more generated back symbols. In this embodiment, if the player designates to hold or save a generated back symbol, then the gaming device will not initiate the regeneration sequence until the player activates the held back symbol.

Referring now to FIG. 5, in one embodiment of the gaming device, the probability of the processor generating a tracking or back symbol could be variable and based on the number of spins. For example, the probability of a tracking symbol being generated would be greater at the beginning of game play. As indicated in column 120, the probability of generating a tracking symbol could be 100% for spins 0 to 10, indicated in column 118, to increase excitement for the player of the game, but drop to 10% for spins 40 to 60. Not only does this ensure the game operates as intended, that is, the player gets an opportunity to re-win their past outcomes, it increases player enjoyment because of the likelihood of getting the chance to have the game re-spin. Likewise, the probability of getting a back symbol could increase with the number of spins as indicated in column 122. Increasing the chances of getting a back symbol as game play continues encourages the player to continue to play the game.

Figure 6A:
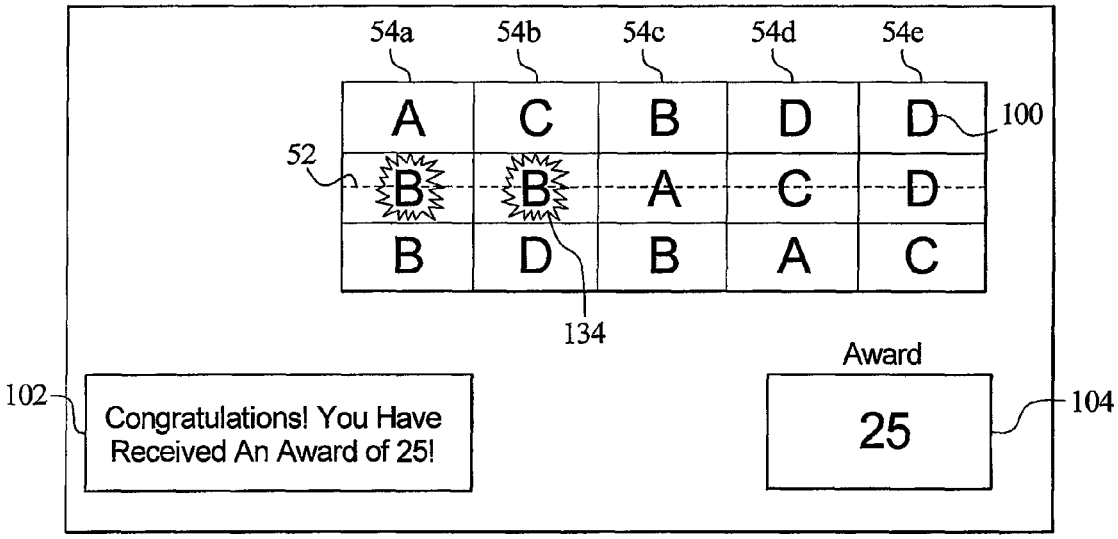
FIGS. 6A, 6B, 6C, 6D, 6E, 6F and 6G are top plan views of one embodiment of the present invention illustrating the outcomes of each symbol generation being automatically flagged for subsequent regeneration.

Referring now to FIGS. 6A through 6G, an example of a primary or base game embodiment of the present invention, without the use of the tracking symbol, is illustrated. In this embodiment, the gaming device automatically flags each outcome and the generated symbols associated with each outcome for later regeneration in a designated area of the memory device. As illustrated in FIG. 6A, upon a player placing a wager, the gaming device generated a plurality of symbols on the reels and determined an outcome based on the generated symbols. The generated symbols and the determined outcome associated with the generated symbols are flagged in the designated area of the memory device. In this case, an outcome of an award of twenty-five associated with the generated symbols is determined and provided to the player. Next, the gaming device determines if one or more back symbols are generated on the reels. In this case, since no back symbols are generated, the gaming device terminates the game sequence. An appropriate message such as "CONGRATULATIONS!" and "YOU HAVE RECEIVED AN AWARD OF 25" can be provided to the player visually, or through suitable audio or audiovisual displays.

Figure 6B:
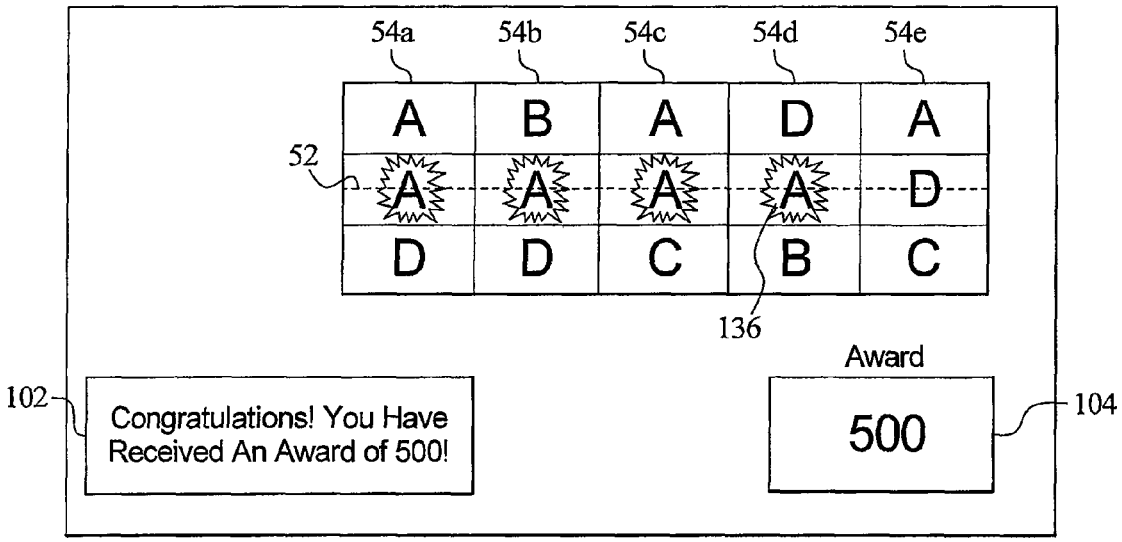

Referring to FIG. 6B, upon the player placing another wager, the gaming device generated another plurality of symbols on the reels and determined an outcome based on the generated symbols. The generated symbols and the determined outcome associated with the generated symbols are flagged in the designated area of the memory device. In this case, an outcome of an award of five hundred associated with the generated symbols is determined and provided to the player. Next, the gaming device determines if one or more back symbols are generated on the reels. In this case, since no back symbols are generated, the gaming device terminates the game sequence. An appropriate message such as CONGRATULATIONS!" and "YOU HAVE RECEIVED AN AWARD OF 500" can be provided to the player visually, or through suitable audio or audiovisual displays.

Figure 6C:
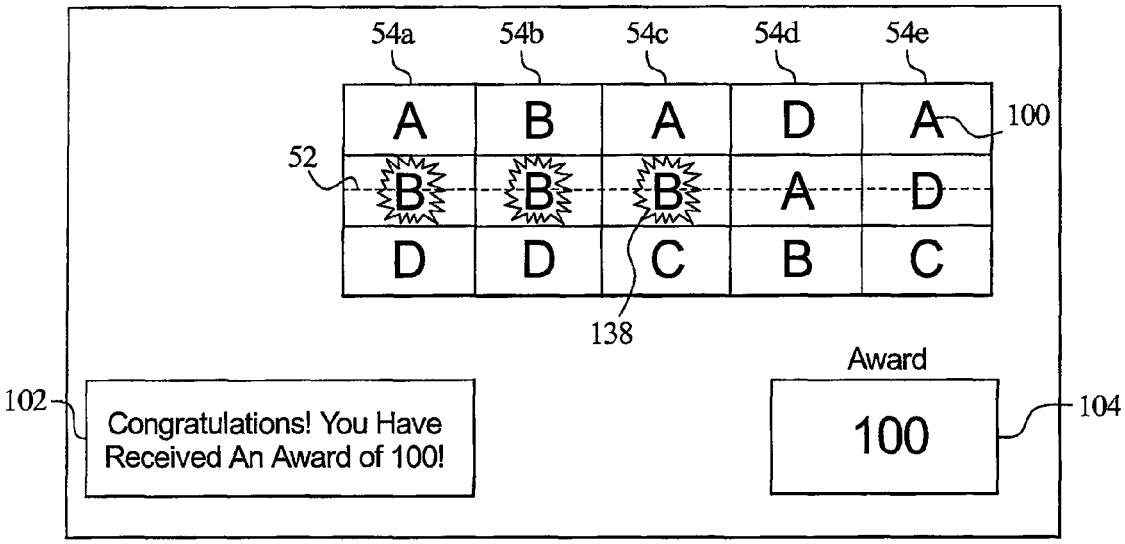

Referring to FIG. 6C, upon the player placing another wager, the gaming device generated another plurality of symbols on the reels and determined an outcome based on the generated symbols. The generated symbols and the determined outcome associated with the generated symbols are flagged in the designated area of the memory device. In this case, an outcome of an award of one hundred associated with the generated symbols is determined and provided to the player. Next, the gaming device determines if one or more back symbols are generated on the reels. In this case, since no back symbols are generated, the gaming device terminates the game sequence. An appropriate message such as "CONGRATULATIONS!" and "YOU HAVE RECEIVED AN AWARD OF 100" can be provided to the player visually, or through suitable audio or audiovisual displays.

Figure 6D:
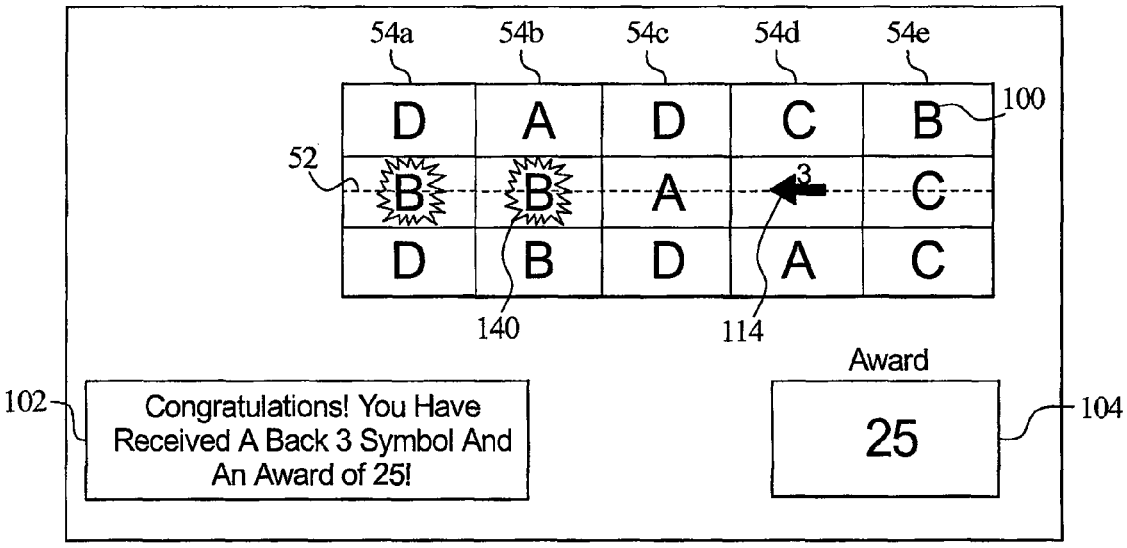
Figure 6E:
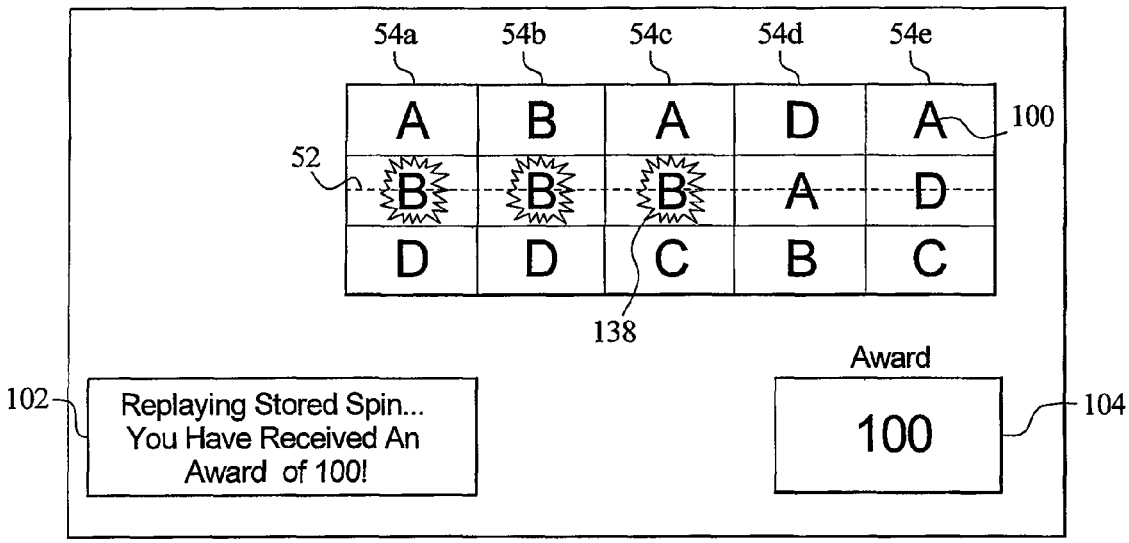
Figure 6F:
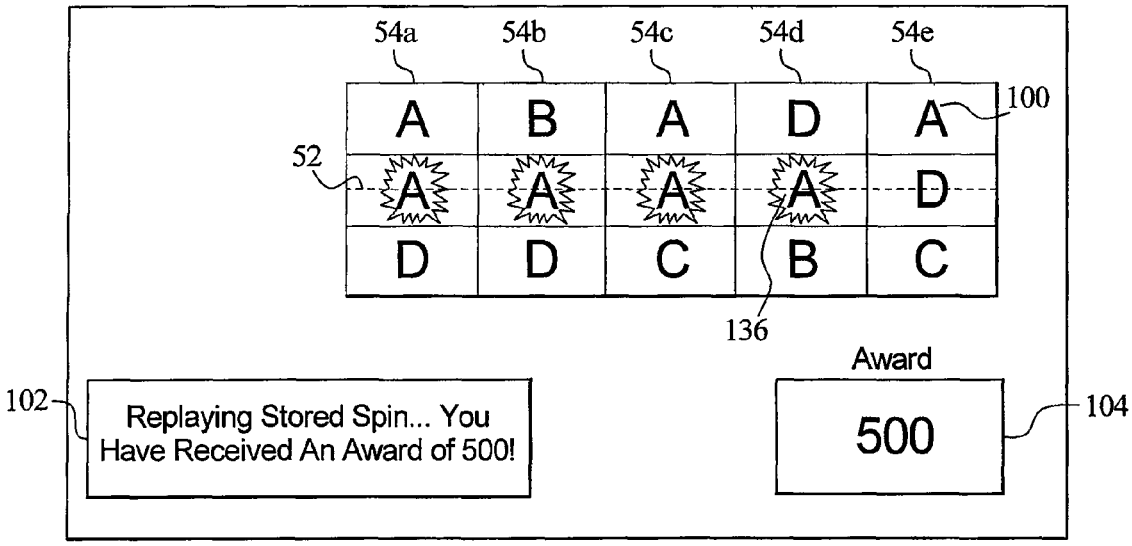
Figure 6G:
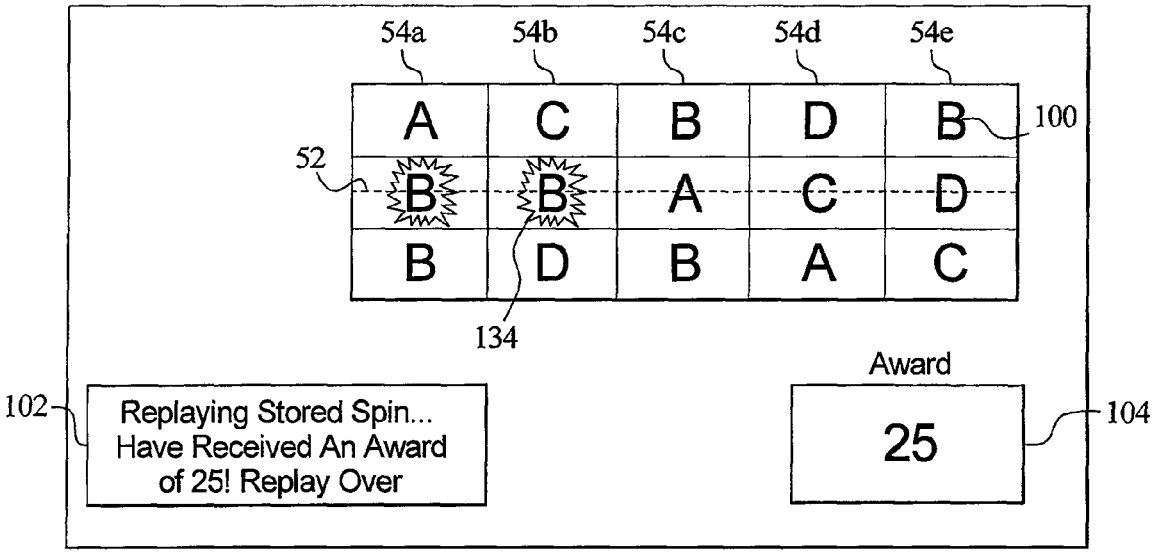

Referring to FIG. 6D, upon the player placing another wager, the gaming device generated another plurality of symbols on the reels and determined an outcome based on the generated symbols. The generated symbols and the determined outcome associated with the generated symbols are flagged in the designated area of the memory device. In this case, an outcome of an award of twenty-five associated with the generated symbols is determined and provided to the player. Next, the gaming device determines if one or more back symbols are generated on the reels. In this case, a back three symbol 138, which is represented by a "←3," was generated on the fourth reel. Therefore, the gaming device is operable to regenerate three of the previously flagged outcomes. FIGS. 6E through 6G illustrate the regenerations.

Referring to FIG. 6E, the gaming device determines if at least one of the designated number of flagged outcomes to be regenerated (i.e., if any of the three regenerations associated with the back three symbol) remains in the designated area of the memory device. In this case, since there is at least one regeneration of a previously generated outcome remaining (i.e., none of the three regenerations associated with the back three symbol have been regenerated), the gaming device regenerates the next flagged outcome associated with the generation of symbols illustrated in FIG. 6C. The processor retrieved the outcome and symbols generated in FIG. 6C from the designated area, removed the flag from the retrieved game outcome and regenerated or replayed the outcome for the player. An award of one hundred associated with the regenerated symbols is provided to the player. An appropriate message such as "REPLAYING FLAGGED SPIN. YOU HAVE RECEIVED AN AWARD OF 100" can be provided to the player visually, or through suitable audio or audiovisual displays.

Referring to FIG. 6F, the gaming device next determines if at least one of the designated number of flagged outcomes to be regenerated remains in the designated area of the memory device. In this case, since there is at least one regeneration of a previously generated outcome remaining (i.e., one of the three regenerations associated with the back three symbol have been regenerated), the gaming device regenerates the next flagged outcome associated with the generation of symbols illustrated in FIG. 6B. The processor retrieved the outcome and symbols generated in FIG. 6B from the designated area removed the flag from the retrieved game outcome and regenerated or replayed the outcome for the player. An outcome of an award of five hundred associated with the regenerated symbols is provided to the player. An appropriate message such as "REPLAYING STORED SPIN. YOU HAVE RECEIVED AN AWARD OF 500" can be provided to the player visually, or through suitable audio or audiovisual displays.

Referring to FIG. 6G, the gaming device next determines if at least one of the designated number of flagged outcomes to be regenerated remains in the designated area of the memory device. In this case, since there is at least one regeneration of a previously generated outcome remaining (i.e., two of the three regenerations associated with the back three symbol have been regenerated), the gaming device regenerates the next flagged outcome associated with the generation of symbols illustrated in FIG. 6A. The processor retrieved the outcome and symbols generated in FIG. 6A from the designated area removed the flag from the retrieved game outcome and regenerated or replayed the outcome for the player. An outcome of an award of twenty-five associated with the regenerated symbols is provided to the player. An appropriate message such as "REPLAYING STORED SPIN. YOU HAVE RECEIVED AN AWARD OF 25" can be provided to the player visually, or through suitable audio or audiovisual displays.

The gaming device next determines if at least one of the designated number of flagged outcomes to be regenerated remains in the designated area of the memory device. In this case, since there are no more regenerations of previously generated outcomes remaining (i.e., three of the three regenerations associated with the back three symbol have been regenerated), the gaming device performs a termination event and stops or terminates the regeneration sequence.

In one embodiment, upon the occurrence of a terminating event ending or resetting the regeneration sequence, the processor stops any regeneration process, removes the outcomes flagged in the designated area of the memory device and indicates to the gaming device not to flag tracking outcomes until the occurrence of another tracking symbol. In one embodiment, game play either returns to a primary game, if the present game is designed as a free spin or other bonus style game or continues without any flagged outcomes. In one embodiment, if the game ends and there are flagged outcomes, the game determines an award based on the flagged outcomes and provides the award to the player. In another embodiment, if the game ends and there are flagged outcomes, the game unflags the outcomes without providing them to the player.

In one embodiment, the terminating event is the regeneration of an outcome containing one or more tracking, back or other symbols. In other embodiments, the terminating event is the retrieval of a predetermined number of flagged outcomes, the retrieval of the last or first flagged outcome, the number of credits falling below a predetermined number or the passage of a period of time or inactivity of the gaming device.

In one embodiment, the regeneration sequence stops upon the regeneration of one or more tracking, back, or other symbols. In another embodiment, the regeneration sequence stops upon the retrieval of a number of flagged outcomes containing a tracking symbol that equals the number of generated back symbols. In another embodiment, the regeneration sequence stops upon the regeneration of a predetermined number of flagged outcomes.

In one embodiment, when the regeneration sequence stops, the flagged outcomes are removed from the designated area of the memory device. In another embodiment, when the regeneration sequence stops, the flagged outcomes are not removed from the designated area of the memory device, allowing them to be regenerated again in the tracking.

In one embodiment, the maximum number of flagged outcomes possible for regeneration is predetermined. Alternatively, the maximum number of flagged outcomes could be determined randomly, in a sub-game provided to the player, based upon the occurrence of one or more symbols on the reels, based upon the wager or any other method of calculating a maximum number of outcomes to flag.

In another embodiment, one or more back or tracking symbols would act as a modifier or multiplier of any outcome or award determined from the generated symbols. That is, the outcome or award associated with the generated symbols would be increased by a predetermined amount, such as multiplying an award by two or three, depending on the number of generated tracking or back symbols. In another embodiment, one or more back or tracking symbols would act as a wild symbol, wherein the generated back or tracking symbols would replace a missing symbol which is needed to form a desired combination.

In one embodiment, the tracking or back symbols could be replaced with an event that triggers the gaming device to indicate the occurrence of a tracking or back event. For example, when a tracking event is generated, the gaming device could emit sounds and display visual indicators, such as blinking lights, to indicate the occurrence of a tracking event.

In one embodiment, the tracking symbol must be generated on an active payline to cause the processor to flag the outcomes in the designated area. In another embodiment, the tracking symbol can be generated on any payline or generated anywhere on the display device to cause the processor to flag the outcomes in the designated area. In another embodiment, a tracking symbol causes the processor to flag the outcomes in the designated area only when generated on a specific reel or reels.

In another embodiment employed in association with free spins or free activations of the symbol generators, each of the generated outcomes (or the outcome data associated with each of the generated outcomes) are automatically marked, flagged or stored in a designated area of the memory device. In this embodiment, at least one and preferably a plurality of the symbols are designated as future or advance symbols. A future or advance symbol is a symbol that, when regenerated by the symbol generators during a regeneration sequence, causes the gaming device to exit the regeneration sequence and return to the pre-regeneration sequence free spin mode. In this embodiment, each back or replay symbol functions as an initiator of the regeneration sequence and terminates the free spin mode and each future or advance symbol functions as a return to the free spin mode or sequence and thus nullifies the terminating effect of a generated back symbol.

In one embodiment, the plurality of symbol generators include at least one future symbol. In another embodiment, the plurality of symbol generators includes a plurality of future symbols. In another embodiment, each of the plurality of symbol generators include at least one future symbol.

In another embodiment, each of the plurality of symbol generators include a plurality of future symbols. In different embodiment, the number of future symbols may be predetermined, randomly determined, determined based on a wager or determined based on any other suitable manner.

FIG. 7 is a table illustrating one free spin embodiment of the present invention wherein a generated back symbol terminates the free spin mode and a subsequently regenerated future symbol nullifies the free spin mode terminating effect of a generated back symbol. In this embodiment, as described above, upon a suitable triggering event, the gaming device initiates a free spin or free activation mode wherein the gaming device automatically flags each outcome for later regeneration. In one embodiment, the gaming device provides the player an unlimited number of free activations of the symbol generators. In different embodiments, the gaming device provides the player a predetermined number of free activations, a randomly determined number of free activations or a number of free activations based on the player's wager in a primary game, the occurrence of one or more symbols in a primary game or any other suitable manner.

In one embodiment of this free spin mode or sequence, the gaming device generates a plurality of symbols on the reels and an outcome associated with the generated symbols or suitable outcome data associated with the generated symbols is determined and flagged in the designated area of the memory device. For example, as illustrated in FIG. 7, free spin number 1 which is indicated in column 140 resulted in a determined outcome of five as indicated in column 142. The gaming device provides the determined outcome to the player and flags the generated symbols, determined outcome and/or outcome data associated with the determined outcome.

After determining and automatically flagging the generated outcome for free spin number 1, the gaming device determines if one or more back symbols are generated on the reels for free spin number 1. In this case, since no back symbols are generated, the gaming device proceeds to the next free activation of the symbol generators, if any, as described above. It should be appreciated that in this embodiment, if no free activations remain, the gaming device ends the free activation mode or sequence and provides the player any outcomes determined during the free activation mode or sequence.

As illustrated in FIG. 7, this example includes an unlimited number of free spins and thus the gaming device proceeds to the next free spin and automatically activates the symbol generators for spins number 2 to 7. As described above, for each of spins number 2 to 7, the gaming device determines the outcome, automatically flags the generated outcome and determines if at least one back symbol is generated. In this case, since no back symbols are generated for spins number 2 to 7, the gaming device proceeds to the next free activation of the symbol generators as described above. It should be appreciated that although a future symbol is generated in spin number 5, since this future symbol is not generated during a regeneration sequence, the future symbol is not associated with any additional function. That is, in this embodiment, a future symbol must be subsequently regenerated during a regeneration sequence in order to nullify the effect of a generated back symbol as described below.

As illustrated in FIG. 7, the gaming device proceeds to generate and flag an outcome as well as determine if any back symbols are generated for spin number 8. In this example, spin number 8 resulted in a back symbol and thus the gaming device initiates the regeneration sequence for one or more of the previously determined outcomes which are automatically flagged in the designated area of the memory device. In this example, the generated back three symbol causes the regeneration sequence to regenerate the three previously generated flagged outcomes. That is, this regeneration sequence will include a regeneration of flagged spins numbers 7, 6 and 5 represented as spins number 8*a*, 8*b* and 8*c*, respectively.

In this embodiment, for each regenerated outcome, the gaming device regenerates, reproduces or redisplays the flagged generated symbols, flagged determined outcome and/or flagged outcome data associated with the flagged outcome and provides the flagged outcome to the player as described above. Additionally, for each regenerated outcome, the gaming device determines if a future symbol is regenerated. If a future symbol is not regenerated and at least one previously generated outcome remains in the regeneration sequence, the gaming device proceeds in regenerating another one of the previously generated outcomes. For example, the gaming device regenerates the outcome of spin number 7 represented as spin number 8*a*, determines that no future symbol is regenerated and at least one previously generated outcome remains in the regeneration sequence and proceeds to regenerating spin number 6 represented as spin number 8*b*. It should be appreciated that the gaming device is operable to regenerated the previously generated outcomes in a last in first out order, a first in first out order, a random order, a predetermined order or any other suitable designated order.

In this embodiment, if a future symbol is generated, the gaming device exits the regeneration sequence and returns to the free spin sequence of the pre-regeneration sequence free spin mode. For example, as the third respin generated in the regeneration sequence causes the regeneration of a future symbol (illustrated as spin number 8*c*), the gaming device exits the regeneration sequence and returns to the free spin mode of spin number 9. It should be appreciated that in one embodiment, similar to the generation of a future symbol in the normal free spin mode, a regeneration of a back symbol in the regeneration sequence will not have any effect. In another embodiment, the regeneration of a back symbol in the regeneration sequence causes a termination of the regeneration sequence and a termination of the free spin mode or sequence.

As illustrated in FIG. 7, as described above, after exiting the regeneration sequence in response to the regeneration of a future symbol, the gaming device automatically activates the symbol generators for spins number 9 to 11, determines the outcomes and automatically flags the generated outcome for each spin.

In spin number 12, the gaming device again generates a back symbol, in this case a back 2 spins symbol and again initiates the regeneration sequence. For each of the spins in this regeneration sequence, (e.g., a regeneration of spin numbers 10 and 11 represented as spins numbers 12*a* and 12*b*), the gaming device regenerates one of the previously generated outcomes, determines if a future symbol is generated and if not future symbol is generated, determines if at least one previously generated outcome remains in the regeneration sequence. In this example, for the first spin in the regeneration sequence (i.e., spin 12*a*), the gaming device regenerates a previously generated outcome, determines that no future symbol is generated and at least one spin remains in the regeneration sequence and proceeds to the next spin in the regeneration sequence. After regenerating a flagged outcome for the next spin in the regeneration sequence (i.e., spin 12*b*), the gaming device determines that as no future symbol is generated and no previously generated outcomes remain in the regeneration sequence, the free spin mode or sequence ends. It should be appreciated that in this example, as no future symbol is regenerated in the regeneration mode to nullify the terminating effects of the generated back symbol, the free spin mode or sequence ends.

FIG. 8 is a table illustrating another embodiment of the present invention wherein the regeneration of a designated symbol in a regeneration mode provides the player with a plurality of additional generations in a future or supplemental generation mode. In one embodiment, the supplemental generation mode provides the player a plurality of additional free spins or future generations of the symbol generators.

In one embodiment, one or more of the generation modes are each associated with a modifier. In one embodiment, the regeneration mode, the present generation mode and the future generation mode are all associated with one or more different modifiers. In this embodiment, any award outcome generated in any mode is modified by the modifier associated with the mode in which that award outcome was generated in. In different embodiments, the modifiers associated with the different generation modes are predetermined, randomly determined, determined based on the player's wager in the primary game, determined from the occurrence of one or more symbols or determined based on any other suitable manner. For example, as indicated in column 144 of FIG. 8, the present generation mode is associated with a modifier of 1×, the regeneration mode is associated with a modifier of 2× and the future generation mode is associated with a modifier of 3×.

In this embodiment, upon a suitable triggering event, the gaming device initiates a present or real-time generation mode wherein the gaming device automatically flags each outcome for later regeneration. In one embodiment, each generation in the present generation mode requires a separate wager. In another embodiment, the present generation mode is provided to the player as a free spin or free activation game wherein the gaming device provides the player an unlimited number of free activations of the symbol generators. In different embodiments, the gaming device provides the player a predetermined number of free activations, a randomly determined number of free activations, a number of free activations based on the player's wager in a primary game, the occurrence of one or more symbols in a primary game or any other suitable manner. As described below, in the example illustrated in FIG. 8, the gaming device provides the player nine generations of the present generation mode.

In the present or real-time generation mode, the gaming device generates a plurality of symbols on the reels and an outcome associated with the generated symbols or suitable outcome data associated with the generated symbols is determined and flagged in the designated area of the memory device. For example, as illustrated in FIG. 8, spin number 1 which is indicated in column 146 resulted in a determined outcome of ten as indicated in column 148. The gaming device modifies the determined outcome by any modifier associated with the present generation mode, in this case a modifier of 1× and provides the determined modified outcome to the player.

After determining and automatically flagging the generated outcome for generation number 1, the gaming device determines if one or more back symbols are generated on the reels for generation number 1. In this case, since no back symbols are generated, the gaming device proceeds to the next activation of the symbol generators, if any, as described above. It should be appreciated that in this embodiment, if no activations remain, the gaming device ends the present or real-time generation mode or sequence and provides the player any outcomes determined during the present or real-time generation mode or sequence.

As illustrated in FIG. 8, in this example the player has eight generations of the present generation mode remaining and thus the gaming device proceeds to the next spin and automatically activates the symbol generators for spins numbers 2 to 5. As described above, for each of spins numbers 2 to 5, the gaming device determines the outcome, modifies the determined outcome by any modifier associated with the present generation mode and provides the determined modified outcome to the player. The gaming device also automatically flags the generated outcome and determines if at least one back symbol is generated. In this case, since no back symbols are generated for spins numbers 2 to 5, the gaming device proceeds to the next activation of the symbol generators as described above. It should be appreciated that although an 'Into the Future' symbol is generated in spin number 4, since this 'Into the Future' symbol is not generated during a regeneration sequence, the 'Into the Future' symbol is not associated with any additional function. That is, in this embodiment, an 'Into the Future' symbol must be subsequently regenerated during a regeneration sequence in order to provide the player with one or more generations in a supplemental or future generation mode as described below.

As illustrated in FIG. 8, the gaming device proceeds to generate and flag an outcome as well as determine if any back symbols are generated for spin number 6. In this example, spin number 6 resulted in a back symbol and thus the gaming device initiates the regeneration sequence for one or more of the previously determined outcomes which are automatically flagged in the designated area of the memory device. In this example, the generated back two symbol causes the regeneration sequence to regenerate the two previously generated flagged outcomes. That is, this regeneration sequence will include a regeneration of flagged spins numbers 5 and 4 represented as spins numbers 6*a* and 6*b*, respectively.

In this embodiment, for each regenerated outcome, the gaming device regenerates, reproduces or redisplays the flagged generated symbols, flagged determined outcome and/or flagged outcome data associated with the flagged outcome. The gaming device also modifies the determined regenerated outcome by any modifier associated with the regeneration mode, in this case a modifier of 2×, and provides the determined modified regenerated outcome to the player.

In one embodiment, after the provided number of regenerations of the regeneration mode, in this case two, the gaming device determines whether to provide the player a future or supplemental generation mode or to return the player to the real-time or present generation mode. In different embodiment, this determination is randomly determined, predetermined, determined based on the player's wager in a primary game, determined based on the occurrence of one or more symbols in a primary game or determined in any other suitable manner. In another embodiment, the gaming device automatically provides the player one or more generations in a future or supplemental generation mode. In another embodiment, as illustrated in FIG. 8, a designated symbol or symbol combination, such as the generation of an "into the future" symbol must be generated during the regeneration mode to provide the player with the future or supplemental generation mode.

If the gaming device determines to return the player to the present or real-time generation mode, the gaming device proceeds to generate and flag any outcome as well as determine if any back symbols generated during any of the remaining generations of the present generation mode as described above.

If the gaming device determines to provide the player at least one outcome in a future or supplemental generation mode, the gaming device provides one or more generations of the symbols generations. It should be appreciated that one or more generations in the future generation mode are each based on one or more subsequent, but not yet generated symbol generations of the present or real-time generation mode. That is, each generation in the future generation mode represents a foreshadowing of one of the generations which will be provided to the player when the player reenters the present generation mode. In other words, the future generation mode functions to provide the player one or more generations which the player will be re-provided upon the player's return to the present or real-time generation mode.

In one embodiment, the future or supplemental generation mode continues until one or more designated symbols or symbol combinations are generated in the future generation mode. In another embodiment, the player is provided a designated number of generations in the future or supplemental generation mode. In different embodiment, the number of provided generations in the is predetermined. In different embodiment, the number of generations in the future generation mode is predetermined, randomly determined, determined based on the player's wager in the primary game, determined from the occurrence of one or more symbols or determined based on any other suitable manner. In another embodiment, the generation of a designated symbol or symbol combinations, such as a 'present mode' symbol, will cause the termination of the future generation mode.

In the future generation mode, the player is provided one or more activations of the symbol generators. For each activation of the symbol generators, the gaming device generates a plurality of symbols on the reels and an outcome associated with the generated symbols or suitable outcome data associated with the generated symbols is determined. The gaming device modifies the determined outcome by any modifier associated with the future generation mode, in this case a modifier of 3× and provides the determined modified outcome to the player. For example, spin number 7 resulted in a determined outcome of fifteen. The gaming device modifies the determined outcome by any modifier associated with the present generation mode, in this case a modifier of 3× and provides the determined modified outcome of forty-five to the player.

After determining and modifying the generated outcome for generation number 7, the gaming device determines if one or more present mode symbols are generated on the reels for generation number 7. In this case, since no present mode symbols are generated, the gaming device proceeds to the next activation of the symbol generators, if any, for the future generation mode. In one embodiment, if no activations of the future generation mode remain, the gaming device ends the future generation mode and returns the player to the present or real-time activation mode or sequence as described above.

In one embodiment, one, more or each of the generations in the future generation mode are each counted as one of the activations provided for the present generation mode. For example, spin number 7 would count as one of the nine generations provided to the player upon the suitable triggering event. In another embodiment, one, more or each of the generations in the future generation mode are not counted as one of the activations provided for the present generation mode.

As illustrated in FIG. 8, the gaming device proceeds to generate and modify an outcome as well as determine if any present symbols are generated in the future generation mode for spin numbers 8 and 9. In this example, spin number 9 resulted in a present mode symbol and thus the gaming device terminates the future generation mode and returns to the present or real-time generation mode.

As described above, after exiting the regeneration sequence and reentering the present generation sequence, the gaming device proceeds with providing generations of the present generation sequence as described above. It should be appreciated that one or more generations in the reentered real-time generation mode correspond to one or more generations provided to the player in the future generation mode. That is, this present generation sequence will include another generation of the previously provided generations numbers 7, 8 and 9 represented as spins numbers 10, 11 and 12, respectively. It should be appreciated that in another embodiment, the regenerations of the outcomes from the future generation mode will occur in one or more subsequent generations not provided to the player. For example, the regenerations of previously provided generation numbers 7, 8 and 9 may occur with present generations 13, 14 and 15. It should be appreciated that in this example, as the present generation sequence ends before generations numbers 13, 14 and 15, the player is not re-provided the previously provided generations from the future generation sequence.

For each remaining generation in the present generation mode, the gaming device determines the outcome, modifies the determined outcome by any modifier associated with the present generation mode and provides the determined modified outcome to the player as described above. The gaming device also automatically flags the generated outcome and determines if at least one back symbol is generated. In this case, since no back symbols are generated for spins numbers 10 to 12, the gaming device proceeds with playing out the remaining number of provided generations in the present generation mode and then ends the game.

In another embodiment (not shown), for each regenerated outcome the gaming device determines a consolation or supplemental award or outcome. In different embodiments the consolation award or outcome is predetermined, randomly determined, determined based on the player's wager in the primary game, determined from the occurrence of one or more symbols or determined based on any other suitable manner. In this embodiment, as each previously generated outcome is regenerated, the gaming device determines if the regenerated outcome is greater than or equal to the determined consolation outcome. If the regenerated outcome is greater than or equal to the determined consolation outcome, the player is provided the regenerated outcome. If the regenerated outcome is less than the determined consolation outcome, the player is provided the consolation outcome. For example, if the gaming device determines a consolation outcome award of ten and the payout associated with the regenerated outcome is five, the player is provided the consolation award of ten. In another embodiment, the gaming device generates a consolation award or outcome for a plurality of the regenerated outcomes. In this embodiment, if the total outcome provided to the player for the plurality of regenerated outcomes is less than the consolation outcome, the player is provided the consolation outcome. In another embodiment, the gaming device generates a consolation award or outcome for each of the regenerated outcomes. In this embodiment, if the total outcome provided to the player for each of the regenerated outcomes is less than the consolation outcome, the player is provided the consolation outcome. In another embodiment, if the awards regenerated during a regeneration sequence are not at least equal to a designated award level, the gaming device will automatically retrigger another regeneration sequence.

In another embodiment (not shown), the present invention is employed with one or more concentric reels. A concentric reel includes an inner reel and an outer reel which are aligned on substantially the same rotational axis. The outer reel includes a plurality of symbols and at least one window. The inner reel includes a plurality of symbols. In different embodiments, the inner reel includes back symbols and/or tracking symbols, the outer reel includes back symbols and/or tracking symbols or both reels include back symbols and/or tracking symbols.

In a play of this embodiment of the game, the gaming device activates the concentric reels which causes the inner reel and the outer reel to move or rotate. When the inner and outer reel stop, one of the symbols of the outer reel or the window is indicated by a payline associated with the concentric reel. If the window is present on the payline, the window indicates or allows a player to see the symbol on the inner reel on the payline. The indicated symbol on the inner reel is part of the evaluated symbol combination with the other symbols of the other reels indicated by the payline. The gaming device provides an award for any winning symbol combination associated with these symbols and proceeds as described above.

It should be appreciated that while the present invention is described in regards to a slot game, the present invention can be implemented into any suitable type of game wherein an outcome is initially generated, flagged and then subsequently regenerated. In one embodiment illustrating a card game, a first set or hand of cards is generated and upon a suitable tracking event, the first set of cards or the outcome associated with the first set of card is flagged. Upon a suitable regenerating event, such as the generation of a specific card or hand of cards, one or more of the flagged sets of cards or flagged outcome are regenerated.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) for each of a plurality of plays of a game:

(i) enable a player to place a wager, (ii) randomly generate one of a plurality of outcomes, (iii) display the randomly generated outcome, (iv) determine if said displayed outcome is associated with one of a plurality of awards, and (v) provide any associated award to the player; and (b) upon a triggering event, sequentially replay a number of said plurality of plays of the game, wherein said number of sequentially replayed plays of the game is at least two, each outcome displayed for each replayed game is the same outcome previously displayed in said play of the game and each award provided for each replayed game is the same award previously provided in said play of the game.

2. The gaming system of claim 1, wherein when executed by the at least one processor, said plurality of instructions cause the at least one processor to sequentially replay said number of previous plays of the game in a first in to first out order.

3. The gaming system of claim 1, wherein when executed by the at least one processor, said plurality of instructions cause the at least one processor to sequentially replay said number of previous plays of the game in a last in to first out order.

4. The gaming system of claim 1, wherein when executed by the at least one processor, said plurality of instructions cause the at least one processor to enable the player to make an input to at least partially determine the number previous plays of the game replayed.

5. The gaming system of claim 1, wherein the number of sequentially replayed plays of the game is determined based on at least one of the wagers placed by the player.

6. The gaming system of claim 1, wherein the number of sequentially replayed plays of the game is determined based on a generation of a symbol for one of the plays of the game.

7. The gaming system of claim 1, wherein the triggering event is a generation of a symbol for one of the plays of the game.

8. The gaming system of claim 1, wherein when executed by the at least one processor, said plurality of instructions cause the at least one processor to store outcome data relating to said plurality of plays of the game.

9. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) for each of a plurality of plays of a game:

(i) generate one of a plurality of outcomes, (ii) display said generated outcome, (iii) determine if said generated outcome is associated with one of a plurality of awards, and (iv) provide any associated award to a player;

(b) save said generated outcomes of the plays of the game; and (c) upon an occurrence of a trigger, for each of said plurality of saved outcomes of the plays of the game, reprovide to the player any award associated with said saved outcome.

10. The gaming system of claim 9, wherein when executed by the at least one processor upon the occurrence of the trigger, said plurality of instructions cause the at least one processor to, for each of said plurality of saved outcomes of the plays of the game, redisplay said saved outcome.

11. The gaming system of claim 9, wherein when executed by the at least one processor upon the occurrence of the trigger, said plurality of instructions cause the at least one processor to, for each of said plurality of saved outcomes of the plays of the game, redisplay any award associated with said saved outcome.

12. A method of operating a gaming system, said method comprising:

(a) for each of a plurality of plays of a game:

(i) enabling a player to place a wager, (ii) randomly generating one of a plurality of outcomes, (iii) displaying the randomly generated outcome, (vi) determining if said displayed outcome is associated with one of a plurality of awards, and (v) providing any associated award to the player; and (b) upon a triggering event, sequentially replaying a number of said plurality of plays of the game, wherein said number of sequentially replayed plays of the game is at least two, each outcome displayed for each replayed game is the same outcome previously displayed in said play of the game and each award provided for each replayed game is the same award previously provided in said play of the game.

13. The method of claim 12, which includes sequentially replaying said number of previous plays of the game in a first in to first out order.

14. The method of claim 12, which includes sequentially replaying said number of previous plays of the game in a last in to first out order.

15. The method of claim 12, which includes enabling a the player to make an input to at least partially determine the number previous plays of the game replayed.

16. The method of claim 12, wherein the number of sequentially replayed plays of the game is determined based on at least one of the wagers placed by the player.

17. The method of claim 12, wherein the number of sequentially replayed plays of the game is determined based on a generation of a symbol for one of the plays of the game.

18. The method of claim 12, wherein the triggering event is a generation of a symbol for one of the plays of the game.

19. The method of claim 12, which includes storing outcome data relating to said plurality of plays of the game.

20. The method of claim 12, wherein said steps are provided through a data network.

21. The method of claim 20, wherein the data network is an Internet.

22. A method of operating a gaming system, said method comprising:

(a) for each of a plurality of plays of a game:

(i) generating one of a plurality of outcomes, (ii) displaying the generated outcome, (iii) determining if said generated outcome is associated with one of a plurality of awards, and (iv) providing any associated award to a player;

(b) saving said generated outcomes of the plays of the game; and (c) upon an occurrence of a trigger, for each of said plurality of saved outcomes of the plays of the game, reprovidinq to the player any award associated with said saved outcome.

23. The method of claim 22, wherein said steps are provided through a data network.

24. The method of claim 23, wherein the data network is an Internet.

25. The method of claim 22, which includes, upon the occurrence of the trigger, for each of said plurality of saved outcomes of the plays of the game, redisplaying said saved outcome.

26. The method of claim 22, which includes, upon the occurrence of the trigger, for each of said plurality of saved outcomes of the plays of the game, redisplaying any award associated with said saved outcome.

* * * * *

Disclaimer

7,993,195 B2 — Matthew E. Belger, N. Las Vegas, NV (US); Darren Maya, Reno, NV (US); Anisur R Chowdhury, Reno, NV (US); Hans Elias, Reno, NV (US); Karen M Cregan, Reno, NV (US); Anthony J Baerlocher, Reno, NV (US). GAMING DEVICE HAVING SEQUENTIAL ACTIVATION OF A GAME AND REPLAY OF PREVIOUS ACTIVATIONS OF THE GAME. Patent dated August 9, 2011. Disclaimer filed-March 24, 2011, by the assignee, IGT.

The term of this patent shall not extend beyond the expiration date of Pat. No. 7,322,887.

(*Official Gazette September 6, 2011*)

UNITED STATES PATENT AND TRADEMARK OFFICE

CERTIFICATE OF CORRECTION

PATENT NO. : 7,993,195 B2
APPLICATION NO. : 12/014533
DATED : August 9, 2011
INVENTOR(S) : Matthew E. Belger et al.

It is certified that error appears in the above-identified patent and that said Letters Patent is hereby corrected as shown below:

In Claim 22, column 32, lines 65 to 66, replace “reprovidinq” with --reproviding--.

Signed and Sealed this
Twenty-seventh Day of September, 2011

David J. Kappos

David J. Kappos
*Director of the United States Patent and Trademark Office*